US007137959B2

(12) United States Patent
Phillips

(10) Patent No.: US 7,137,959 B2
(45) Date of Patent: Nov. 21, 2006

(54) PARAPLEGIC REHABILITATION APPARATUS

(75) Inventor: Edward H. Phillips, Troy, MI (US)

(73) Assignee: RLE Corporation, Troy, MI (US)

( * ) Notice: Subject to any disclaimer, the term of this patent is extended or adjusted under 35 U.S.C. 154(b) by 24 days.

(21) Appl. No.: 11/069,174

(22) Filed: Mar. 1, 2005

(65) Prior Publication Data

US 2006/0128537 A1 Jun. 15, 2006

Related U.S. Application Data

(60) Provisional application No. 60/645,247, filed on Jan. 19, 2005, provisional application No. 60/635,902, filed on Dec. 14, 2004.

(51) Int. Cl.
*A61H 1/02* (2006.01)

(52) U.S. Cl. ..... 601/5; 601/23; 601/35; 482/51

(58) Field of Classification Search ..... 601/5, 601/23, 24, 26, 27, 33, 34, 35, 50; 482/51, 482/56, 70, 95, 121, 123, 129, 130, 142, 482/148, 907; 602/23, 36; 607/49
See application file for complete search history.

(56) References Cited

U.S. PATENT DOCUMENTS 4,403,773 A 9/1983 Swann ..... 482/145
4,659,077 A 4/1987 Stropkay ..... 482/70
4,986,261 A * 1/1991 Iams et al. ..... 482/51
5,029,848 A 7/1991 Sleamaker
5,449,336 A 9/1995 Sabel ..... 482/130
5,496,246 A 3/1996 Pierre ..... 482/130
5,820,519 A 10/1998 Slenker ..... 48/4
5,941,800 A * 8/1999 Laconis ..... 482/70
6,228,004 B1 5/2001 Steinbach et al. ..... 482/121
6,261,250 B1 * 7/2001 Phillips ..... 601/23
6,592,502 B1 * 7/2003 Phillips ..... 482/121
6,685,658 B1 * 2/2004 Dietz et al. ..... 601/5

OTHER PUBLICATIONS

Brochure, "EECP TREATMENT", Relief from Angine, an educational service of Vasomedical, Inc. (7 pages).

Brochure, "EECP—A New Therapy For Angina Pectoris"—A Patient's Guide to Enhanced External Couterpulsation; Vasomedical, Inc., HeartBeat publication vol. 3, No. 2, (6 pages).

* cited by examiner

*Primary Examiner*—Quang D. Thanh
(74) *Attorney, Agent, or Firm*—Gifford, Krass, Groh, Sprinkle, Anderson & Citkowski, P.C.

(57) ABSTRACT

Walking motion apparatus and methods for use thereof are provided for enabling paraplegic, quadriplegic, brain injured and various other handicapped patients to implement a natural walking motion while either supporting no weight, or alternately, a selected portion of their weight.

13 Claims, 10 Drawing Sheets

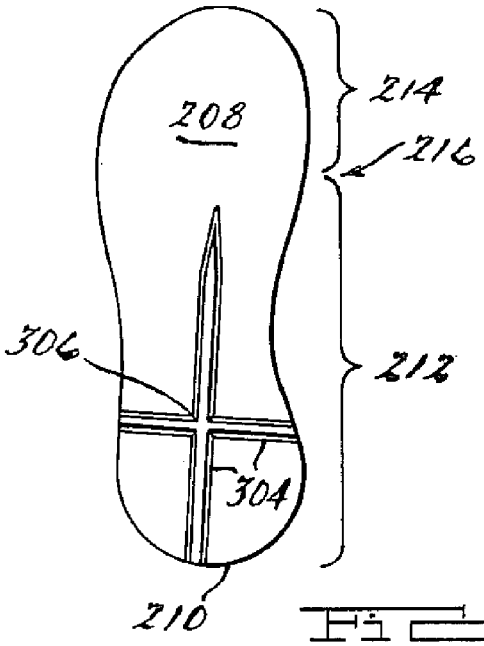

FIG. 11A.

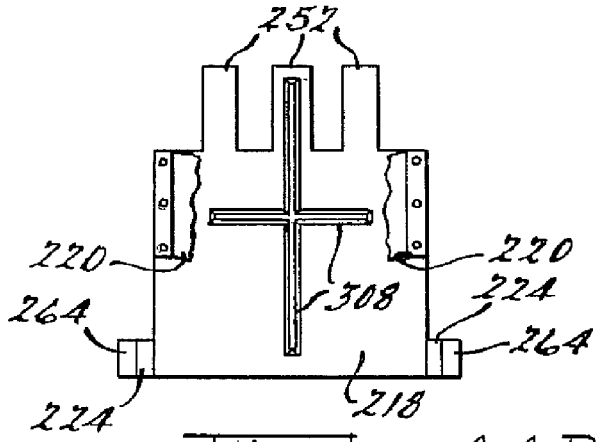

FIG. 11B.

Have The Patient Don Appropriate Knee Braces Comprising Hinged Bails

↓

Position The Patient In The Supine Position Under The Rhythmic Limb Elevation Drive Mechanism

↓

Position And Affix The Patient's Shoes Upon Left And Right Articulated Slide Subsystems Comprised In The Foot Guiding Mechanism

↓

Attach First And Second Limb Groups Each Including One Of The Hinged Bails And An Opposing Hand To First And Second Sets Of Pulley-Supported Lines Comprised In The Rhythmic Limb Elevation Drive Mechanism

↓

Activate A Rhythmic Limb Elevation Drive Unit Comprised In The Rhythmic Limb Elevation Drive Mechanism At A Selected Walking Frequency

FIG. 12.

Activate The Elevation Drive Mechanism To An Angular Elevation Whereat The Patient Is Supporting A Selected Portion Of His Or Her Weight Prior To Activating The Rhythmic Limb Elevation Drive Unit At The Selected Walking Frequency

FIG. 13.

PARAPLEGIC REHABILITATION APPARATUS

RELATED APPLICATIONS

This application claims priority of U.S. Provisional Patent Application Ser. Nos. 60/635,902 filed Dec. 14, 2004 and 60/645,247 filed Jan. 19, 2005.

BACKGROUND OF THE INVENTION

The present invention relates generally to apparatus useful in rehabilitative programs for paraplegic and quadriplegic individuals, and even health maintenance programs for individuals that are totally unable to care for themselves such as those in a deep coma, and more particularly to method and apparatus for assisting such individuals to exercise in a true walking manner, and concomitantly for implementing rhythmic modulation of blood flow and pressure in a manner generally suitable for reestablishing nominally acceptable cardiovascular circulation and muscular tissue regeneration throughout the body and particularly in the lower extremities.

Paraplegic and quadriplegic individuals have by definition suffered traumatic injuries to their spinal cords that have rendered them unable to sense contact with and/or to control functions of the portions of their bodies located beyond their injury sites. Of first concern and most immediate danger following such an injury is a loss of ability to adequately control blood pressure and to regulate distribution of blood flow beyond the injury site. It can take days or even weeks for such individuals to re-acquire sufficient blood pressure control to allow them to be put into a sitting position without "blacking out" for lack of blood flow through their brains. Specifically, their ability to adequately control cardiovascular system arterioles and pre-capillary sphincters has been significantly compromised, and furthermore, major portions of their venous pumping systems have been substantially deactivated as a result of the obvious inactivity of their legs. Also of concern for such individuals as well as those that are totally bedridden for any reason is the difficulty they experience in servicing infections due to any cause as a consequence of compromised cardiovascular circulation. In fact, such infections are a major cause of death for such individuals even while they remain hospitalized.

It is believed herein that the present inventor's previous experience with particular reference to a claimed "method for enhancing a patient's cardiovascular activity and health" described in U.S. Pat. No. 6,261,250 B1 entitled METHOD AND APPARATUS FOR ENHANCING CARDIOVASCULAR ACTIVITY AND HEALTH THROUGH RHYTHMIC LIMB ELEVATION and issued to Edward H. Phillips on Jul. 17, 2001, and a claimed "method for enhancing physical activity and cardiovascular health" described in U.S. Pat. No. 6,592,502 B1 entitled METHOD AND APPARATUS FOR ENHANCING PHYSICAL AND CARDIOVASCULAR HEALTH, AND ALSO FOR EVALUATING CARDIOVASCULAR HEALTH and issued to Edward H. Phillips on Jul. 15, 2003 is pertinent to solving the cardiovascular circulation problems of paraplegic and quadriplegic individuals described above. Because of their obvious pertinence to the subject at hand, both the '250 and '502 patents are expressly incorporated herein by reference.

Of additional interest herein however, is the possibility of retraining paraplegic and quadriplegic, and even severely brain injured individuals, to gradually begin to support their own weight and perhaps even eventually to walk on their own via utilization of method and apparatus for enabling them to continuously exercise in a true walking manner while supporting selectively increased portions of their own weight. This is believed herein to be feasible because of experiments previously conducted with a paraplegic individual on apparatus configured in accordance with the incorporated '502 patent wherein that individual not only dramatically improved her cardiovascular circulation and developed muscle mass having improved tone, but she was able to voluntarily fire her mid-torso, hip flexor and thigh muscles as though she were walking. In fact, in so doing she was so violently firing her thigh muscles that she was hyper-extending her knees.

This is particularly exciting in view of recent experiments wherein new genetically matched spinal cord is formed and then positioned in such a manner as to link the previously severed spinal cord elements of paraplegic and quadriplegic patients. In some cases such experiments have been conducted with tissue grown from embryonic tissue, while in other and perhaps even more exciting cases, such experiments have been conducted with tissue grown from the patients' own DNA after that DNA had been directly harvested via their olfactory cavities. One problem with these recent experiments however, is an observed difficulty in retraining these patient's neurological systems to correlate signals coming in a "South-North direction" with actual bodily locations and to concomitantly direct operative commands to particular muscle groups in a "North-South direction". Another problem is a tendency for many paraplegic individuals to selectively contract some muscle groups in such a manner that their lower extremities tend to physically interfere with one another during any type of exercise. Thus, positive control of foot and knee location is a requirement for any effective rehabilitative equipment. It is believed herein that the apparatus to be disclosed hereinbelow will resolve such problems and that the repetitive walking motion induced by it will prove to be instrumental in achieving the herein expressed goals. Thus, providing method and apparatus for implementing the above-described improved cardiovascular circulation, growth of high quality muscle mass, and support of selected portions of their own weight and perhaps even of walking by paraplegic, quadriplegic and brain injury patients are primary objects of the present invention.

There are of course other handicapped or partially handicapped persons that are desirous of regaining the ability to walk. Obvious examples of such persons are those acclimating to newly fashioned artificial lower limbs (i.e., unfortunately now including military, other war victims, and even more recently, those that suffered lower limb amputations as a result of the tsunami that occurred in the Indian ocean), victims of stroke, the 60,000 diabetics who suffer lower limb amputations each year in the U.S. alone, and those with any form of neuromuscular disease. Thus, providing such individuals with apparatus for implementing the above-described support of selected portions of their own weight while re-acclimating to walking is yet another object of the present invention.

SUMMARY OF THE INVENTION

These and other objects are achieved via utilization of walking motion apparatus presented in a preferred embodiment of the present invention by a supinely disposed patient in implementing a substantially normal walking motion while supporting a selected portion of his or her weight. Also respectively presented in first, second, third and, fourth alternate embodiments are elevation drive, rhythmic limb elevation drive, foot guiding, and patient handling mechanisms therefor. Further, presented in a fifth alternate preferred embodiment of the present invention are methods for improving cardiovascular circulation, growing high quality muscle mass, supporting selected portions of such a patient's own weight, and even of enabling that patient to fire muscle groups normally utilized in walking. As is more fully explained below, the walking motion apparatus is configured such that a wheel chair bound individual can utilize it in all respects without assistance, and such that even a quadriplegic or severely brain injured individual can utilize it with minimal assistance. For convenience in further discussion however, utilization of the walking motion apparatus is assumed to be by a wheel chair bound individual having nominal use of his or her hands and arms (hereinafter "patient") unless its use by a quadriplegic or severely brain injured individual is specifically indicated.

The walking motion apparatus preferably comprises all of the elevation drive, rhythmic limb elevation drive, foot guiding, and patient handling mechanisms in order to enable all of the above listed benefits. When so configured, patients are able to set the walking motion apparatus up in a customized manner with regard to their desired leg stroke, hip elevation, walking frequency, and weight-supporting fraction. Further, they are able to get into it and properly attach themselves to the rhythmic limb elevation drive mechanism, and finally, to operate the walking motion apparatus—all without assistance. This is deemed herein to be necessary because it should be recognized that such patients prefer to take care of themselves insofar as possible, and particularly to do so without being manhandled. And of course, it is appropriate to eliminate or at least reduce therapist assistance for obvious economic reasons.

In actually utilizing the walking motion apparatus, a wheelchair bound patient first dons appropriate knee braces comprising hinged bails. Then he or she uses a controller to position the elevation drive mechanism to an intermediate position whereat he or she can conveniently open a rhythmic limb elevation drive unit comprised in the rhythmic limb elevation drive mechanism and set leg stroke length. Then he or she resets the elevation drive and patient handling mechanisms to base positions whereat a pivoting seat back portion of the patient handling mechanism is oriented with respect to a seating platform such that together they are disposed in an upright seating position at normal wheelchair height. Next, he or she moves to a position laterally proximate to the seating platform, and if desired, positions a "buddy board" for transition from the wheelchair to the seating platform. Then using his or her hands on the wheelchair, buddy board and/or the seating platform, the patient moves onto the seating platform in a centered position whereat he or she is positioned astride a "horn" portion of the of the pivoting seat back (i.e., a bicycle seat-like protrusion extending from the seat back in a nominally orthogonal direction thereto but of course nominally parallel to the seating platform) that is nestled within a pocket formed in the seating platform when the pivoting seat back is disposed in the upright seating position. Again using the controller, the patient moves the patient handling mechanism forward, and if desired, rotates the pivoting seat back portion thereof to locations whereat he or she can conveniently position his or her shoes upon shoe orienting protrusions located upon articulated slide assemblies and affix them thereat with comprised hook and loop (i.e., "Velcro") straps. Next, the patient attaches knee elevating pulley-supported lines of the rhythmic limb elevation drive mechanism to the hinged bails of the knee braces. Then again using the controller and observing his or her legs via an overhead spherical mirror, the patient next moves the patient handling mechanism to a location that will optimize the intended walking motion. Then still using the controller, the patient rotates the pivoting seat back and him- or herself into a horizontal position whereat he or she is located supinely with his or her thighs straddling the horn portion of the seat back thus being centered thereon during walking exercises to follow. Yet again using the controller, the patient activates the elevation drive mechanism to a selected angular elevation angle whereat he or she is supporting a selected portion of his or her weight and presets a selected walking frequency. Finally, he or she grabs arm elevating pulley-supported lines and activates the rhythmic limb elevation drive mechanism via lateral arm motion against a latching on/off switch to implement the intended walking exercise. Whenever the scheduled walking exercise program is completed, the patient stops the rhythmic limb elevation drive unit by again activating the latching on/off switch, and then extricates him- or herself from the walking motion apparatus by reversing the above described procedure.

A walking motion apparatus elevation drive mechanism used for selectively elevating operative portions of the walking motion apparatus is presented in a first alternate preferred embodiment of the present invention. Operative components of the elevation drive mechanism comprise a guide block mounted roll and yaw-axes constraining bearing slidingly positioned along a rail fixedly attached to a nominally horizontal member of a stationary floor mounted frame by a nut that is engaged by a lead screw that is in turn rotationally positioned by a suitable drive gearmotor; and an offset pitch axis constraining tie-rod, where a first end of the tie-rod is swivelingly attached to a vertical member of the stationary floor mounted frame while the bearing and other end of the tie-rod are operatively attached to and utilized to selectively elevate an angularly elevating frame upon which all of the other above named mechanisms are mounted via operation of the drive gearmotor.

A walking motion apparatus rhythmic limb elevation drive mechanism used for implementing intended walking exercises is presented in a second alternate preferred embodiment of the present invention. Similarly to RLE apparatus presented in the incorporated '502 patent, respective first and second limb groups respectively including left and right articulated slide assemblies, and corresponding legs and opposing hands are supportingly coupled to a frame structure of the rhythmic limb elevation drive mechanism by first and second sets of pulley-supported lines. The rhythmic limb elevation drive mechanism of the present invention is differentiated from the RLE apparatus presented in the incorporated '502 patent however, in that it comprises a compact rhythmic limb elevation drive unit having primary and secondary sheave assemblies for actively driving the first and second sets of pulley-supported lines in an oscillating translational manner and thus drivingly implement the desired walking motions of the patient's first and second limb groups. The primary sheave assembly is utilized for generating the fundamental walking motion while the secondary sheave assemblies are driven in a selected phase leading manner and utilized for implementing proper knee flexure of each leg within that fundamental walking motion. This is accomplished via linkages to the knees provided by pulley blocks through which the pulley-supported lines from the secondary sheave assemblies are coupled to selected sheaves of the primary sheave assembly. Preferably then, the rhythmic limb elevation drive unit comprises: primary and secondary hubs constrained for oscillating rotational motion; multiple primary sheaves mounted upon and drivingly coupled to the primary hub, and first and second secondary sheaves mounted upon and drivingly coupled to first and second secondary hubs with the first and second sets of pulley-supported lines being selectively attached to the various sheaves including knee supporting pulley-supported lines coupled both to selected sheaves of the primary sheave assembly and to the first and second secondary sheaves via the knee supporting pulley blocks; a gearmotor having a driven output shaft that rotates continuously at a selected rotational speed during operation of the rhythmic limb elevation drive unit; and continuous rotation to oscillating rotational motion conversion apparatus including a fixed member fixedly mounted upon the output shaft of the gearmotor, an adjustable sliding element comprising an eccentric shaft member, an adjustment assembly for positioning the adjustable sliding element at a preselected eccentricity with respect to the output shaft of the gearmotor, a first cam follower mounted upon the eccentric shaft member, a Scotch yoke assembly adapted for being driven by the first cam follower, a primary ball-screw spline assembly comprising a first shaft member having ball screw raceways and ball spline grooves crossing one another, a ball spline nut, a first ball screw nut and a ball bearing supported outer race surrounding the first ball screw nut, the first shaft member of which being fixedly coupled to and driven by the Scotch yoke assembly, a second cam follower also mounted upon the eccentric shaft member, cam blocks also adapted for being driven by the first cam follower, a stop block for limiting inward travel of the cam blocks, and secondary ball-screw spline assemblies each comprising second shaft members having ball screw raceways and ball spline grooves crossing one another, ball spline nuts, second ball screw nuts, and ball bearing supported outer races surrounding the second ball screw nuts, the second shaft members being fixedly coupled to and intermittently driven by the cam blocks beyond their stop block limited positions, the continuous rotation to oscillating rotational motion conversion apparatus for drivingly coupling the output shaft of the gearmotor to the primary and secondary hubs for driving the primary and secondary hubs and sheaves in a rotational oscillating manner at a frequency equal in value to the rotational speed of the output shaft with a selected phase relationship between the primary and secondary hubs and sheaves, and thereby driving the first and second sets of pulley-supported lines in a translational oscillating manner and thus drivingly implementing the desired rhythmic limb elevation (hereinafter "RLE") motions of the patient's first and second limb groups at that frequency in a natural walking motion including appropriate flexing of the knees.

A walking motion apparatus foot guiding mechanism for controlling the patient's foot location and motions is presented in a third alternate preferred embodiment of the present invention. In the foot guiding mechanism left and right articulated slide assemblies are positioned for longitudinal movement along left and right rails. First and second pulley-supported lines driven by the rhythmic limb elevation drive unit are attached to the upper ends of the left and right articulated slide assemblies while a single pulley-supported line is utilized to functionally couple their lower ends in order to ensure that upward forces exerted thereupon by a patient are properly applied to the rhythmic limb elevation drive unit via an opposing articulated slide assembly and pulley-supported line. In addition, proper foot and leg articulation is controlled during the walking exercise via locating the patient's shoes on posterior foot supporting plates via protrusions formed on the posterior foot supporting plates and selectively positioned and mating shoe orienting grooves formed in the patient's shoes, and then retaining them thereon with the above mentioned hook and loop straps. The posterior foot supporting plates are coupled to adjustable trailing link members by under heel articulation points and the adjustable trailing link members are in turn coupled to the articulated slide assemblies' slide members via ball-of-the-foot articulation points. Longitudinal positions of the under heel articulation points are adjustable with respect to the ball-of-the-foot articulation points in the general manner found in "clamp-on" roller skates in order to properly accommodate various patient foot sizes.

A walking motion apparatus patient handling mechanism for allowing the patient to enter and utilize the walking motion apparatus is presented in a fourth alternate preferred embodiment of the present invention. As mentioned hereinabove, the patient handling mechanism comprises a seating platform and a pivoting seat back located with respect to one another such that the horn portion of the seat back nestles within the pocket formed in the seating platform when the seat back is disposed in an upright seating position. The pivoting seat back is constrained for pivotal rotation about a transverse pivot axis constrained for controlled motion along a slide axis that is nominally orthogonal to the foot guiding mechanism and located in a relatively elevated manner such that adequate clearance is provided for ensuing leg motion during the walking exercise after seat back is rotated into a horizontal position. Elevation toward the horizontal position is accomplished via vertical motion of a powered slide whereby a transverse hip axis is constrained for motion in a direction nominally parallel to the foot guiding mechanism. This ensures that the distance between the patient's hips and the foot guiding mechanism remains nominally constant as the seat back is elevated. Further, the seat back itself is mounted upon a longitudinally oriented (e.g., after the seat back has attained its nominally horizontal position) short stroke slide component of the pivoting mechanism. The short stroke slide is provided for accommodating normal up-and-down motions that the patient will experience during the walking exercise. Finally, the pivoting mechanism is adjustably coupled to the angularly elevating frame via a powered slide assembly constrained for longitudinally oriented motion (e.g., motion nominally orthogonal to the with respect to the foot guiding mechanism) in order to provide for the above-mentioned overall positioning of the patient handling mechanism.

In addition, interchangeable seat backs are accommodated via a seat back interchanging mechanism located above the short stroke slide. This is deemed necessary herein because patients come in all torso lengths and girths. Furthermore, different seat back designs are required for patients having varying degrees of torso control. For instance, a quadriplegic or brain injured patient may need torso and even head constraints while a patient nearly ready to walk on his or her own would desire a compliant seat back, or perhaps even an articulated seat back.

Finally, methods for improving a patient's cardiovascular circulation, growing high quality muscle mass, and even of firing muscle groups normally utilized in walking are presented in a fifth alternate preferred embodiment of the present invention. These methods are implemented in conjunction with utilization of a walking motion apparatus comprising at least the rhythmic limb elevation drive and foot guiding mechanisms wherein a supinely disposed patient can affect a substantially normal walking motion, and wherein a first and most general method comprises the steps of: the patient donning appropriate knee braces comprising hinged bails; positioning the patient in the supine position under the rhythmic limb elevation drive mechanism; positioning and affixing the patient's shoes upon left and right articulated slide assemblies comprised in the foot guiding mechanism; attaching first and second limb groups each including one of the hinged bails and an opposing hand to first and second sets of pulley-supported lines comprised in the rhythmic limb elevation drive mechanism; and activating a rhythmic limb elevation drive unit comprised in the rhythmic limb elevation drive mechanism at a selected walking frequency.

In addition, the present invention is directed to a second and enhanced version of the first method wherein the walking motion apparatus additionally comprises an elevation drive mechanism whereby the supinely disposed patient can affect the substantially normal walking motion while supporting a selected portion of his or her weight, and thus wherein the method comprises the additional step of: activating and positioning the elevation drive mechanism at an angular elevation whereat the patient is supporting a selected portion of his or her weight prior to activating the rhythmic limb elevation drive unit at the selected walking frequency.

The present invention is also directed to a still further enhanced third version of the method wherein the walking motion apparatus additionally comprises a patient handling mechanism whereby the patient can, without assistance, set up and get into the walking motion apparatus, properly attach him- or herself to the rhythmic limb elevation drive mechanism, and operate the walking motion apparatus, wherein the method comprises the patient performing the steps of: positioning the elevation drive mechanism to an intermediate position whereat he or she can conveniently open the rhythmic limb elevation drive unit comprised in the rhythmic limb elevation drive mechanism even while being wheelchair bound; opening the rhythmic limb elevation drive unit; setting stroke length; closing the rhythmic limb elevation drive unit; resetting the elevation drive mechanism to its base position; moving to a position laterally proximate to a pivoting seat back and seating platform comprised in the patient handling mechanism and located generally under the rhythmic limb elevation drive mechanism; moving onto the seating platform in a centered position whereat the patient is positioned against the seat back and astride a "horn" portion thereof nestled within a pocket formed in the seating platform; moving the patient handling mechanism forward, and if desired, rotating the pivoting seat back to a location whereat the patient can conveniently position his or her shoes upon the left and right articulated slide assemblies; positioning and affixing his or her shoes thereon; attaching first and second sets of knee elevating pulley-supported lines to the hinged bails; moving the patient handling mechanism to a location sufficiently removed from the foot guiding mechanism for optimizing the intended walking motion; rotating the seat back into a horizontal position whereat the patient is located supinely with his or her thighs straddling the horn portion of the seat back and thus keeping him or her centered thereon during the ensuing walking exercise; activating and positioning the elevation drive mechanism at the angular elevation whereat the selected portion of the patient's weight is self supported; presetting the rhythmic limb elevation drive unit comprised in the rhythmic limb elevation drive mechanism at the selected walking frequency; grabbing first and second arm elevating pulley-supported lines; and activating the rhythmic limb elevation drive unit at the selected walking frequency.

In a first aspect then, the present invention is directed to providing a walking motion apparatus for drivingly implementing true walking exercise by an incapacitated patient comprising: a foot guiding mechanism having left and right supporting rails, and left and right articulated slide assemblies adapted for having the patient's left and right feet respectively coupled thereto in a supportive manner and positioned for movement along the left and right supporting rails; first and second hinged bails for supporting the patient's left and right knees; a first set of pulley-supported lines for supporting and driving a first limb group of the patient including his or her left foot via the left articulated foot slide assembly, his or her left knee via the first hinged bail, and his or her right hand; a second set of pulley-supported lines for supporting and driving a second limb group of the patient including his or her right foot via the right articulated foot slide assembly, his or her right knee via the second hinged bail, and his or her left hand; a rhythmic limb elevation drive unit for driving the first and second sets of pulley-supported lines in an oscillating translational manner and thus drivingly implementing the desired walking motions of the patient's first and second limb groups; and a frame structure for mounting the foot guiding assembly, rhythmic limb elevation drive unit and supporting the patient.

In a second aspect, the present invention is directed to the walking motion apparatus of the first aspect wherein the rhythmic limb elevation drive unit comprises: knee supporting pulley blocks coupled to the hinged bails; primary, and first and second secondary hubs constrained for oscillating rotational motion; a primary sheave assembly mounted upon and drivingly coupled to the primary hub, and first and second secondary sheaves mounted upon and drivingly coupled to the first and second secondary hubs, where the first and second sets of pulley-supported lines are selectively attached to the various sheaves with first and second double ended ones thereof being attached to and coupling selected sheaves of a primary sheave assembly and the first and second secondary sheaves via the knee supporting pulley blocks; a gearmotor having a driven output shaft that rotates continuously at a selected rotational speed during operation of the rhythmic limb elevation drive unit; and continuous rotation to oscillating rotational motion conversion apparatus for drivingly coupling the output shaft of the gearmotor to the primary and secondary hubs for driving the primary and secondary hubs and sheaves in an oscillating rotational manner at a frequency equal in value to the rotational speed of the output shaft, and thereby driving the first and second sets of pulley-supported lines in an oscillating translational manner and thus drivingly implementing the desired RLE motions of the patient's first and second limb groups at that frequency in a natural walking motion including appropriate flexing of the knees.

In a third aspect, the present invention is directed to the walking motion apparatus of the second aspect wherein the continuous rotation to oscillating rotational motion conversion apparatus comprises: a primary ball-screw spline assembly comprising a first shaft member having ball screw raceways and ball spline grooves crossing one another, a ball spline nut, a ball screw nut and a ball bearing supported outer race surrounding the ball screw nut; a Scotch yoke assembly fixedly coupled to the first shaft member; a first cam follower adapted for continuously driving the Scotch yoke assembly; secondary ball-screw spline assemblies each comprising second shaft members having ball screw raceways and ball spline grooves crossing one another, ball spline nuts, ball screw nuts and ball bearing supported outer races surrounding the ball screw nuts; cam blocks fixedly coupled to the second shaft members; a stop block for limiting inward travel of the cam blocks; a second follower for intermittently driving the cam blocks beyond their stop block limited positions; an eccentric shaft member for concomitantly driving the first and second cam followers; and a transverse slide assembly comprising a fixed member fixedly mounted upon the output shaft of the gearmotor, an adjustable sliding element comprising the eccentric shaft member, and an adjustment assembly for positioning the adjustable sliding element at a preselected eccentricity with respect to the output shaft of the gearmotor.

In a fourth aspect, the present invention is directed to the walking motion apparatus of the first aspect wherein the foot guiding mechanism having left and right supporting rails, and left and right articulated slide assemblies further comprises: first and second pulley-supported lines of the first and second sets of pulley-supported lines being respectively attached to upper ends of the left and right articulated slide assemblies; a single pulley-supported line for coupling lower ends of the left and right articulated slide assemblies in order to ensure continuous downward motion of the left or right articulated slide assembly not instantly being urged upwards by its respective first or second pulley-supported line in the event of an upward force being exerted thereon by a patient, and that any such upward force is properly applied to the rhythmic limb elevation drive unit via the other articulated slide assembly and respective pulley-supported line; and articulative foot supporting assemblies for articulatively coupling the patient's feet to the articulated slide assemblies in order to allow for proper foot and leg articulation during a walking exercise.

In a fifth aspect, the present invention is directed to the walking motion apparatus of the fourth aspect wherein the articulative foot supporting assemblies comprise: posterior foot supporting plates having shoe orienting protrusions for orienting and supporting a patient's shoes formed with corresponding grooves; straps for holding the patient's shoes in place on the posterior foot supporting plates as located by the foot orienting protrusions; adjustable trailing link members coupled to the posterior foot supporting plates by under heel articulation points, the adjustable trailing links being adjustable in order to properly accommodate various patient foot sizes; slide members slidingly coupled to the rails; and ball-of-the-foot articulation points for coupling the adjustable trailing link members to the slide members.

In a sixth aspect, the present invention is directed to the walking motion apparatus of the first aspect wherein the frame structure includes an elevation drive mechanism comprising: a stationary floor mounted frame; an angularly elevating frame rotationally coupled to the stationary floor mounted frame whereupon the foot guiding mechanism and rhythmic limb elevation drive unit are mounted, and the patient is supportively located with respect to either; a controller; and angular elevation drive apparatus operatively adapted for selective rotational positioning of the angularly elevating frame with respect to the stationary floor mounted frame in response to operation of the controller.

In a seventh aspect, the present invention is directed to the walking motion apparatus of the sixth aspect wherein the angular elevation drive apparatus comprises: a rail fixedly mounted on a nominally horizontal member of the stationary floor mounted frame; a guide block slidingly coupled to the rail; a nut affixed to the guide block; a drive gearmotor; a lead screw drivingly coupled to the drive gearmotor and engaging the nut; a roll and yaw-axes constraining bearing mounted upon the guide block; off-axis vertical and arm members respectively included as portions of the stationary floor mounted and angularly elevating frames; and a pitch axis constraining tie-rod for coupling tie-rod anchor points of the off-axis vertical and arm members one to another with a predetermined span length therebetween, whereby the angularly elevating frame can be angularly elevated in dependence upon instant locations of the guide block along the rail as implemented by controlled operation of the drive gearmotor via the controller.

In an eighth aspect, the present invention is directed to the walking motion apparatus of the first aspect wherein the walking motion apparatus additionally includes a patient handling mechanism comprising; a seating platform; a pivoting seat back having a nominally orthogonal horn portion wherein the pivoting seat back is located with respect to the seating platform such that the horn portion nestles within a pocket formed in the seating platform when the pivoting seat back is disposed in an upright seating position; a pivoting mechanism adapted for rotationally elevating the pivoting seat back into a nominally supine position; and a drive mechanism for drivingly elevating and pivoting the seat back in accordance with the positional constraints imposed by the pivoting mechanism.

In a ninth aspect, the present invention is directed to the walking motion apparatus of the eighth aspect wherein the pivoting seat back and pivoting mechanism comprise: a transverse pivot axis about which the seat back pivots that is located in a relatively elevated manner such that adequate clearance is provided for ensuing leg motion during the walking exercise after seat back is rotated into a horizontal position; a transverse hip axis constrained for powered motion along a nominally vertical axis such that the distance between a patient's hips and a foot guiding mechanism remains nominally constant as the seat back is elevated; a longitudinally oriented short stroke slide component for slidingly mounting the seat back along a longitudinal axis in order to accommodate normal up-and-down motions that a patient experiences during a walking exercise; and a powered slide assembly for adjustably coupling the pivoting mechanism to the angularly elevating frame along the longitudinal axis for appropriately locating the patient's hips with respect to the foot guiding mechanism.

In a tenth aspect, the present invention is directed to a method for improving a paraplegic or quadriplegic patient's cardiovascular circulation, growing high quality muscle mass, and even of firing muscle groups normally utilized in walking, wherein the method is implemented in conjunction with utilization of a walking motion apparatus comprising at least rhythmic limb elevation drive and foot guiding mechanisms wherein a supinely disposed such patient can affect a substantially normal walking motion, and wherein the method comprises the steps of: the patient donning appropriate knee braces comprising hinged bails; positioning the patient in the supine position under the rhythmic limb elevation drive mechanism; positioning and affixing the patient's shoes upon left and right articulated slide assemblies comprised in the foot guiding mechanism; attaching first and second limb groups each including one of the hinged bails and an opposing hand to first and second sets of pulley-supported lines comprised in the rhythmic limb elevation drive mechanism; and activating a rhythmic limb elevation drive unit comprised in the rhythmic limb elevation drive mechanism at a selected walking frequency.

In an eleventh aspect, the present invention is directed to the method of the eleventh aspect wherein the walking motion apparatus additionally comprises an elevation drive mechanism whereby the supinely disposed patient can affect the substantially normal walking motion while supporting a selected portion of his or her weight, and wherein the method comprises the additional step of: activating the elevation drive mechanism to an angular elevation whereat the patient is supporting a selected portion of his or her weight prior to activating the rhythmic limb elevation drive unit at the selected walking frequency.

In a twelfth and final aspect, the present invention is directed to a method for improving a paraplegic or quadriplegic patient's cardiovascular circulation, growing high quality muscle mass, and even of firing muscle groups normally utilized in walking, wherein the method is implemented in conjunction with utilization of a walking motion apparatus comprising rhythmic limb elevation drive, foot guiding, elevation drive and patient handling mechanisms whereby the patient can, without assistance, set up and get into the walking motion apparatus, properly attach him- or herself to the rhythmic limb elevation drive mechanism and operate the walking motion apparatus in order to achieve a substantially normal walking motion while supported in a selectively elevated supinely disposed position, and wherein the method comprises the patient performing the steps of: positioning the elevation drive mechanism to an intermediate position whereat he or she can conveniently open the rhythmic limb elevation drive unit comprised in the rhythmic limb elevation drive mechanism even while being wheelchair bound; opening the rhythmic limb elevation drive unit; setting stroke length; closing the rhythmic limb elevation drive unit; resetting the elevation drive mechanism to its base position; moving to a position laterally proximate to a pivoting seat back and seating platform comprised in the patient handling mechanism and located generally under the rhythmic limb elevation drive mechanism; moving onto the seating platform in a centered position whereat the patient is positioned against the seat back and astride a "horn" portion thereof nestled within a pocket formed in the seating platform; moving the patient handling mechanism forward, and if desired, rotating the pivoting seat back to locations whereat the patient can conveniently position his or her shoes upon the left and right articulated slide assemblies; positioning and affixing his or her shoes thereon; attaching first and second sets of knee elevating pulley-supported lines to the hinged bails; moving the patient handling mechanism to a location sufficiently removed from the foot guiding mechanism for optimizing the intended walking motion; rotating the seat back into a horizontal position whereat the patient is located supinely with his or her thighs straddling the horn portion of the seat back and thus keeping him or her centered thereon during the ensuing walking exercise; activating and positioning the elevation drive mechanism at the angular elevation whereat the selected portion of the patient's weight is self supported; presetting the rhythmic limb elevation drive unit comprised in the rhythmic limb elevation drive mechanism at the selected walking frequency; grabbing first and second arm elevating pulley-supported lines; and activating the rhythmic limb elevation drive unit at the selected walking frequency.

BRIEF DESCRIPTION OF THE DRAWING

A better understanding of the present invention will now be had with reference to the accompanying drawing, wherein like reference characters refer to like parts throughout the several views therein, and in which:

FIG. 6 is an exploded isometric view depicting a method of fixedly coupling a shaft to a machine element having a flat surface;

FIGS. 11A and 11B are plan views respectively depicting shoe locating grooves and protrusions utilized for positioning a patient's shoes on the foot guiding mechanism;

FIG. 12 is a flow chart depicting a method for utilizing a walking motion apparatus of the present invention to improve a patient's cardiovascular circulation, grow high quality muscle mass, and even to fire muscle groups normally utilized in walking;

FIG. 13 is a flow chart depicting a method for additionally supporting increasing portions of the patient's own weight while effecting the improvements depicted in the flow chart of FIG. 12.

DETAILED DESCRIPTION OF THE PREFERRED EMBODIMENTS

Figure 1A:
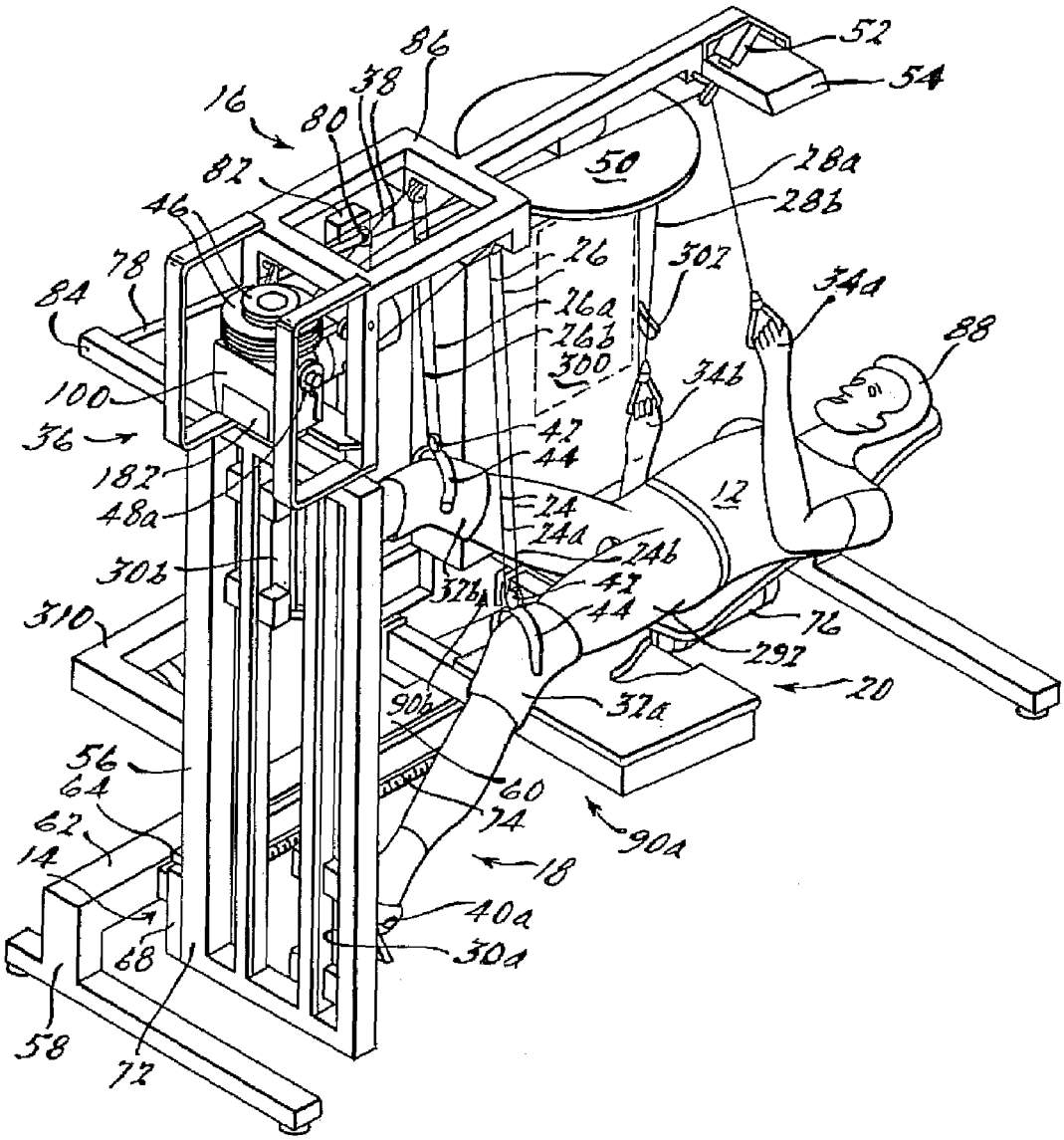
FIGS. 1A and 1B are isometric views depicting a walking motion apparatus respectively disposed in initial and maximally elevated positions.
Figure 1B:
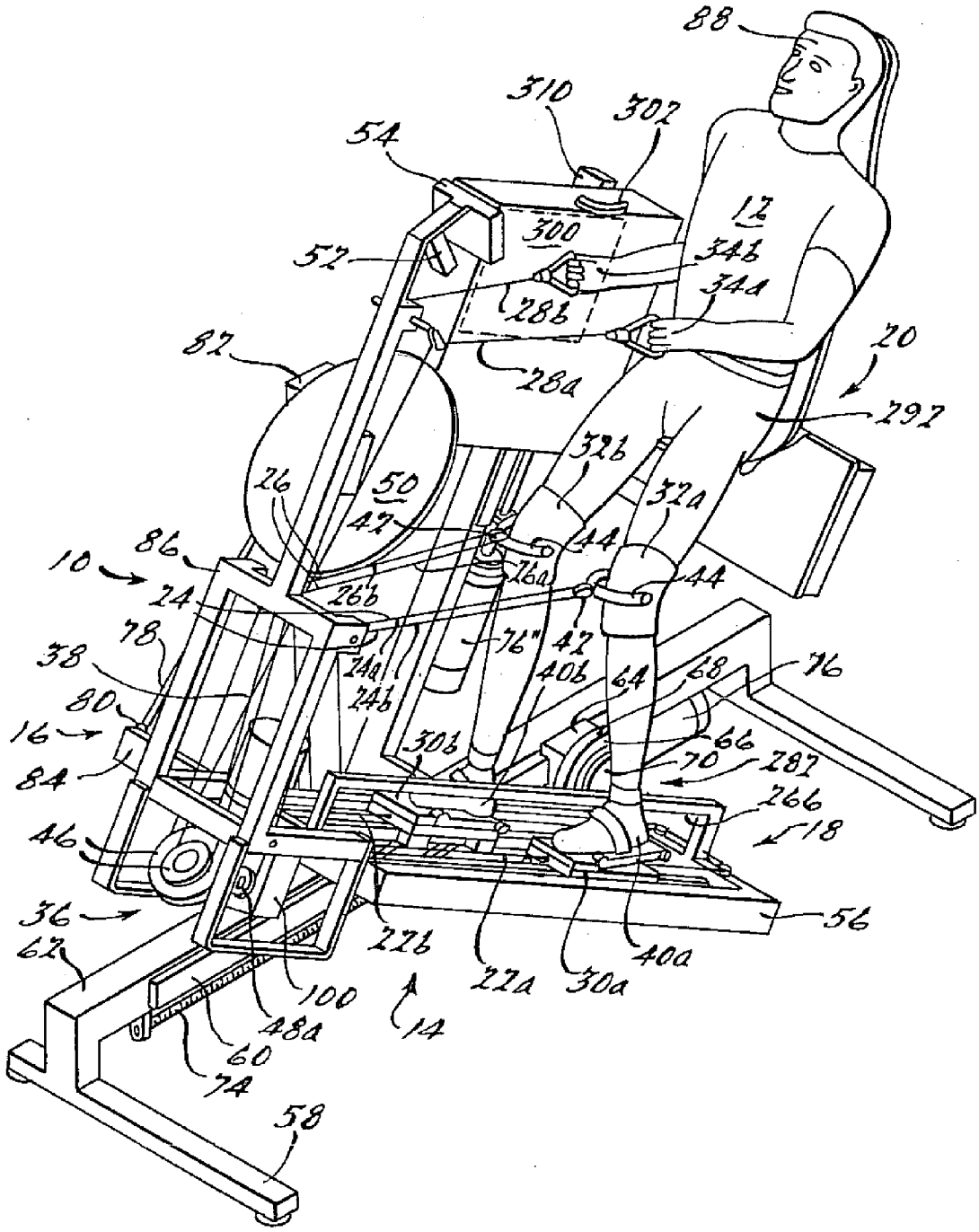

With reference first to FIGS. 1A and 1B, there shown are isometric views of a walking motion apparatus 10 respectively disposed in initial and maximally elevated positions in accordance with the preferred embodiment of the present invention. The walking motion apparatus 10 is optimized for use by a supinely disposed paraplegic or otherwise wheelchair bound patient 12, or even a quadriplegic patient 12, in implementing a substantially normal walking motion while supporting a selected portion of his or her weight. As further described hereinbelow, the walking motion apparatus 10 comprise an elevation drive mechanism 14, a rhythmic limb elevation drive mechanism 16, a foot guiding mechanism 18, and a patient handling mechanism 20, all configured such that a wheelchair bound individual can utilize the walking motion apparatus 10 in all respects without assistance, and such that a quadriplegic or even a severely brain injured individual can utilize it with minimal assistance. For convenience in further discussion however, utilization of the walking motion apparatus 10 is assumed to be by a wheelchair bound individual (hereinafter "patient 12") unless use by a quadriplegic individual is specifically indicated.

The elevation drive mechanism 14 is adapted for rotationally elevating the walking motion apparatus 10 from an initial position whereat the patient 12 is horizontally disposed in a supine position and "walking" on a vertically disposed foot guiding mechanism 18 as shown in FIG. 1A, to a preselected position whereat the patient 12 is angularly elevated such that he or she supports a desired portion of his or her weight. As shown in FIG. 1B, the elevation drive mechanism 14 is capable of angularly elevating the patient 12 by as much as 60 degrees whereat he or she is supporting some 87% of his or her weight and "walking" on the foot guiding mechanism 18 correspondingly oriented at an incline angle of 30 degrees. As described below, pulley-supported lines 22*a* and 22*b*, 24 and 26, and 28*a* and 28*b* comprised in the rhythmic limb elevation drive mechanism 16 are respectively attached to left and right articulated slide assemblies 30*a* and 30*b* of the foot guiding mechanism 18, first and second knee braces 32*a* and 32*b*, and the patient's left and right hands 34*a* and 34*b*. They are utilized to effect the walking motion in accordance with oscillating translational motions provided by a rhythmic limb elevation drive unit 36 where the pulley-supported lines 28*a* and 28*b* are arranged in a crossing pattern as denoted by numerical Indicator 38 in order to cause the left hand 34*a* to move synchronously with the right font 40*b* and the right hand 34*b* to move synchronously with the left foot 40*a*.

Figure 2:
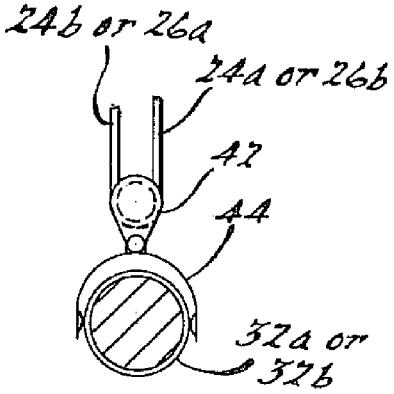
FIG. 2 is a view depicting a hinged bail supported pulley block utilized for elevating a patient's knees.

In FIG. 1A the patient 12 is depicted in maximum stride with the left or trailing foot 40*a* "toeing off" and the right or leading foot 40*b* positioned to land heel first, whereas in FIG. 1B, the patient 12 is depicted in mid-stride with the left foot 40*a* swinging forward and the right foot 40*b* supporting weight as it moves backward. Further inspection of FIG. 1B reveals that the patient's advancing trailing left knee brace 32*a* must be advanced in a leading phase manner with respect to the advancing left articulated slide assembly 30*a* and the patient's advancing trailing right hand 34*b*. This problem is overcome by bifurcating pulley-supported lines 24 and 26 into primary and secondary portions 24*a* and 24*b*, and 26*a* and 26*b* coupled to the first and second knee braces 32*a* and 32*b* via pulley blocks 42 and hinged bails 44 as depicted in FIG. 2, and then coupling the primary portions 24*a* and 26*a* to primary sheaves 46 and the secondary portions 24*b* and 26*b* to secondary sheaves 48*a* and 48*b*. The primary sheaves 46 are utilized for implementing the primary walking motion and the secondary sheaves 48*a* and 48*b* are utilized for adding a supplementary phase shifted knee flexing motion for the first and second knee braces 32*a* and 32*b* as will be further disclosed below in conjunction with a description of the rhythmic limb elevation drive mechanism 16.

As shown in both of FIGS. 1A and 1B, a spherical mirror 50 can be provided in order to enable the patient 12 to view the walking motion. Alternately, a video camera 52 and video monitor 54 can be used for the same purpose, and also for remote patient monitoring. And of course, the video monitor 54 can also be used for visual entertainment.

With further reference now to FIGS. 1A and 1B, there shown in accordance with a first alternate preferred embodiment of the present invention is the elevation drive mechanism 14 where an angularly elevating frame 56 thereof is respectively shown in initial and maximally elevated positions with respect to a floor-mounted stationary frame 58. Operative components of the elevation drive mechanism 14 comprise a linear motion guiding device comprising a rail 60 mounted upon a nominally horizontal member 62 of the stationary frame 58 and a glide block 64. A robust crossed roller bearing 66 (e.g., hidden in FIG. 1A but visible in FIG. 1B) is mounted within a bearing housing 68 and retained therein with an internal beveled retaining ring (not shown), and then mounted upon a hub 70 and retained thereon with an external beveled retaining ring (also not shown). The hub 70 is fixedly mounted upon the glide block 64 and the bearing housing 68 is fixedly mounted on the angularly elevating frame 56 (e.g., both with bolts not shown) thereby locating the lower internal corner 72 of the angularly elevating frame 56 in a roll and yaw constrained manner with respect to the stationary frame 58. The guide block 64 and hub 70 are positioned along the rail 60 by a nut member 282 drivingly engaged by a lead screw 74 that is in turn rotationally positioned by a "Cyclo" drive gearmotor 76. Pitch axis constraint for the angularly elevating frame 56 is provided by an offset pitch axis constraining tie-rod 78. Either end of the tie-rod 78 comprises a spherical bearing rod end 80 whereby attachment is made to a vertical member 82 of the stationary frame 58 and a rearward extending arm 84 of the angularly elevating frame 56. Thus the elevation drive mechanism 14 is operatively utilized to selectively elevate the angularly elevating frame 56 via operation of the drive gearmotor 76. All of the other above named mechanisms are mounted upon the angularly elevating frame 56 and are of course thereby subject to identical angular elevation. Suitable linear motion guiding devices are available from THK America, Inc. of Schaumburg, Ill., crossed roller bearings are available from IKO International of Parsippany, N.J., and Cyclo gearmotors are available from Sumitomo Machinery Corporation of America of Chesapeake, Va.

Figure 3:
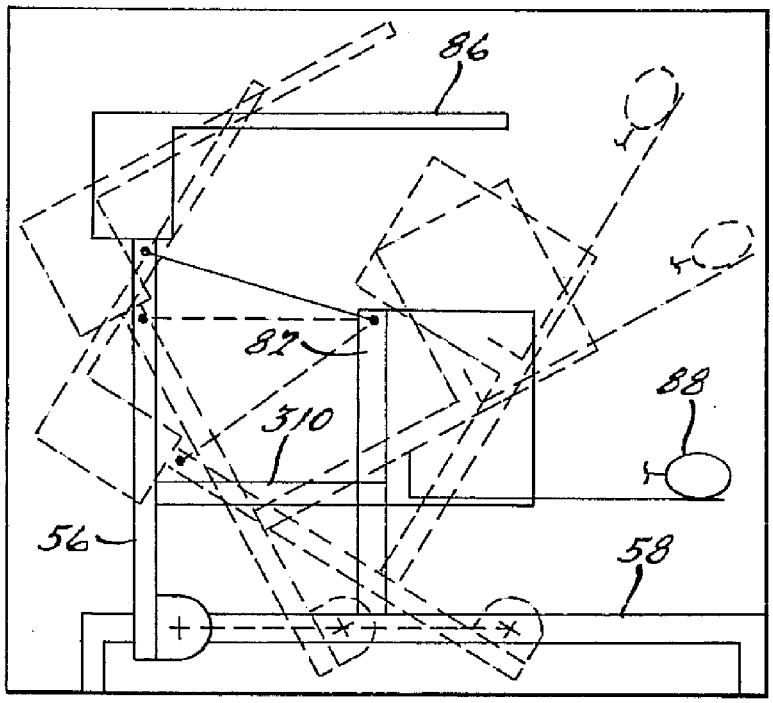
FIG. 3 is a schematic geometric drawing depicting operation of an elevation drive mechanism of the walking motion apparatus.

Utilization of the elevation drive mechanism 14 described above results in a minimal required floor space of slightly over 3 feet wide by perhaps only about 9 feet long for the walking motion apparatus 10 as well as it fitting under an eight-foot ceiling. This is illustrated in FIGS. 1A and 1B wherein the patient 12 is depicted as being 6' 8" in height. It is further illustrated in the view depicted in FIG. 3 where the angularly elevating frame 56 and floor-mounted stationary frame 58 are depicted in schematic form with the angularly elevating portions of the angularly elevating frame 56 including the angularly elevating frame 56, a frame structure 86 of the rhythmic limb elevation drive mechanism 16, and the 6' 8" tall patient's head 88 shown in initial, intermediate and fully elevated positions. Moreover, configuring the walking motion apparatus 10 with the elevation drive mechanism 14 positioned to one side with the rhythmic limb elevation drive mechanism 16, foot guiding mechanism 18, and much of the patient handling mechanism 20 cantilevered therefrom as shown in FIGS. 1A and 1B results in maximal access for and to the patient 12. None-the-less, the elevation drive mechanism 14 disclosed above should be regarded as exemplary in nature in view of the fact that all sorts of alternate elevation drive mechanisms could be utilized without deviation from the spirit of the invention.

Similarly to RLE apparatus presented in the incorporated '502 patent, a first limb group 90*a* including the first articulated slide assembly 30*a*, the hinged bail 44 flexibly linked to the first knee brace 32*a*, and the opposite or second one of the patient's hands 34*b* is supportingly coupled to the frame structure 86 by a first set of pulley-supported lines 22*a*, 24 and 28*b*, and a second limb group 90*b* including the second articulated slide assembly 30*b*, the hinged bail 44 flexibly linked to the second knee brace 32*b* and the opposite or first one of the patient's hands 34*a* is supportingly coupled to the frame structure 86 by a second set of pulley-supported lines 22*b*, 26 and 28*a*. As depicted in FIGS. 1A and 1B, the rhythmic limb elevation drive mechanism 16 of the present invention is differentiated from the RLE apparatus presented in the incorporated '502 patent in that it comprises the compact rhythmic limb elevation drive unit 36 having the primary sheaves 46 and secondary sheaves 48*a* and 48*b* for actively driving the first and second sets of pulley-supported lines 22*a* 24 and 28*a*, and 22*b*, 26, and 28*b* in an oscillating translational manner rather than utilizing a passive energy absorbing apparatus such as any of those disclosed in the incorporated '502 patent, and is thus enabled for drivingly implementing the desired walking motions of the patient's first and second limb groups 90*a* and 90*b*. The primary sheaves 46 are utilized for generating the fundamental walking motion while the secondary sheaves 48*a* and 48*b* are utilized for implementing proper knee flexure of each leg within that fundamental walking motion via linkages to the hinged bails 44 provided by the pulley blocks 42 through which the primary and secondary portions 24*a* and 24*b*, and 26*a* and 26*b* of the pulley-supported lines 24 and 26 are coupled to one another.

Figure 4:
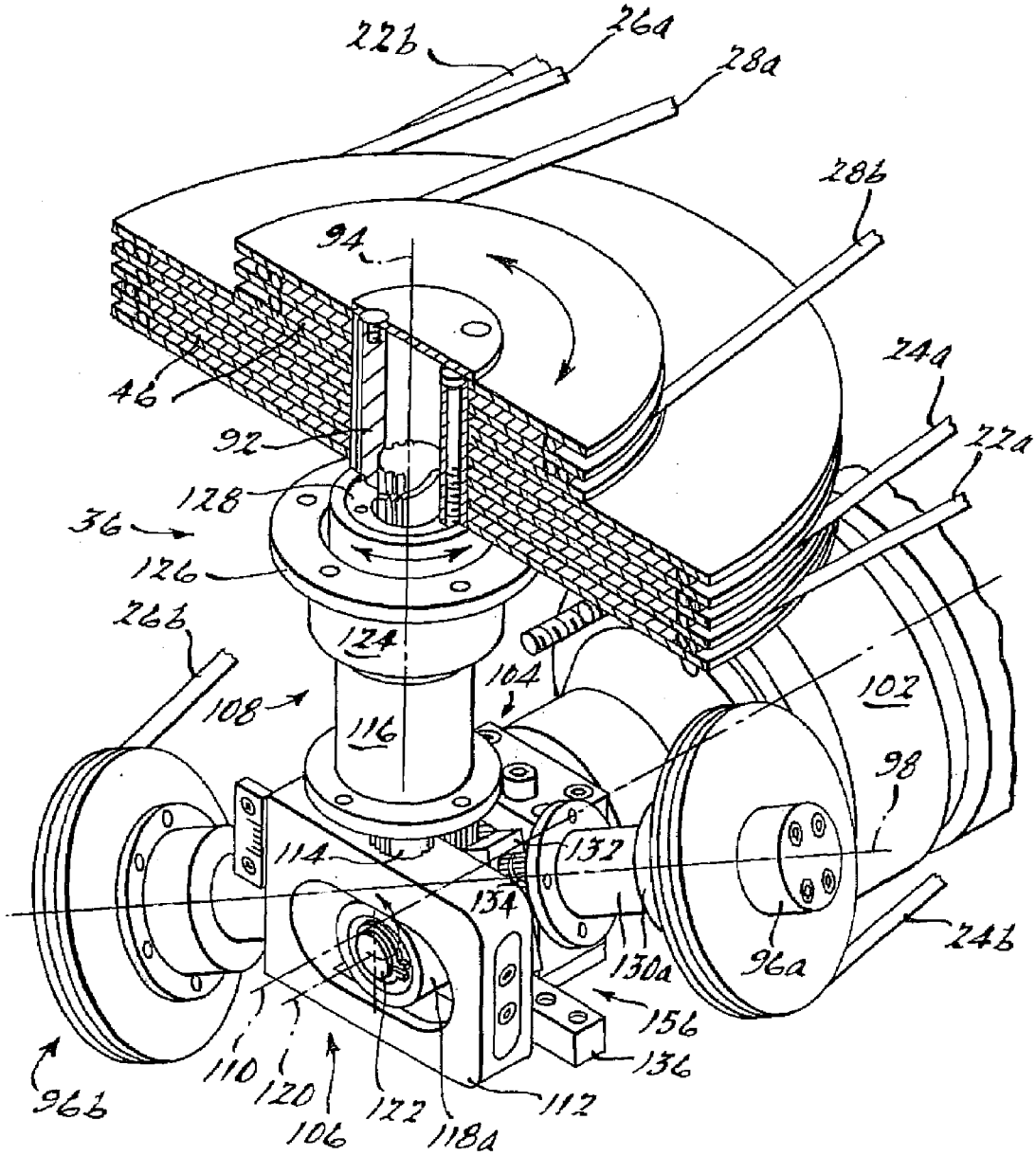
FIG. 4 is a partially cut-away isometric view of working components of a rhythmic limb elevation drive unit comprised in a walking motion apparatus limb elevation drive mechanism.
Figure 9:
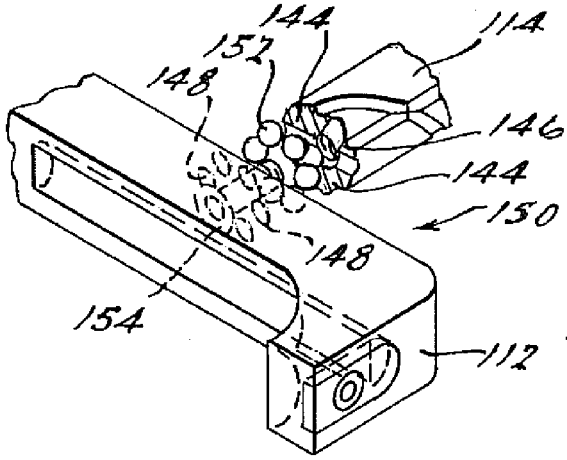
FIGS. 9A, 9B, 9C and 9D are schematic views of a patient's foot depicted at different phases of a natural walking stride.

With reference now to FIG. 4, there shown in accordance with a second alternate preferred embodiment of the present invention is a partially cut-away isometric view of working components of the rhythmic limb elevation drive unit 36. The rhythmic limb elevation drive unit 36 comprises a primary hub 92 rotating about a first axis 94 whereupon the primary sheaves 46 are mounted and fixedly secured for rotation therewith, and secondary hubs 96*a* and 96*b* rotating about a second axis 98 whereupon the secondary sheaves 48*a* and 48*b* are respectively mounted and fixedly secured for rotation therewith. As shown in FIGS. 1A and 1B but omitted in FIG. 4 for clarity, operative elements of the rhythmic limb elevation drive unit 36 are mounted on or housed within a drive housing 100 that in turn is fixedly mounted on the frame structure 86. The prime mover for the rhythmic limb elevation drive unit 36 is another Cyclo gearmotor 102 again available from Sumitomo Machinery Corporation of America of Chesapeake, Va. The gearmotor 102 is mounted on the drive housing 100 and has a driven output shaft 104 that rotates continuously at a selected rotational speed during operation of the rhythmic limb elevation drive unit 36. As described in detail below, a Scotch yoke assembly 106 is utilized for converting the rotational motion of the driven output shaft 104 into an oscillating translational motion of selected magnitude. And as further described below, a ball-screw spline assembly 108 (i.e., also available from THK America, Inc.) is then used to convert the oscillating translational motion into a corresponding oscillating rotational motion of the primary and secondary hubs 96*a* and 96*b* at a frequency equal in value to the rotational speed of the driven output shaft 104, thereby driving the primary and secondary sheaves 46, 48*a* and 48*b*, and the pulley-supported lines 22*a* and 22*b*, 24, 26, and 28*a* and 28*b* in the desired oscillating translational manner and thus drivingly implementing the desired walking motions of the patient's first and second limb groups 90*a* and 90*b* at that frequency. Should individualized operating frequencies be desired for different patients, a variable frequency drive (not shown) such as one of S-Series AC Drives available from TB Wood's Incorporated of Chambersburg, Pa. may be utilized.

Within the rhythmic limb elevation drive unit 36, the primary and secondary hubs 96*a* and 96*b* are mounted along the first and second axes 94 and 98, and the driven output shaft 104 of the gearmotor 102 is positioned along a third axis 110 that nominally intersects and is orthogonal to both of the first and second axes 94 and 98. A yoke member 112 of the Scotch yoke assembly 106 is fixedly coupled to a non-rotating shaft member 114 (i.e., having ball screw raceways and ball spline grooves crossing one another) of the ball-screw spline assembly 108 in accordance with a method depicted in FIG. 6 and described in detail below. Both the non-rotating shaft member 114 and the yoke member 112 are constrained for translational motion in a direction substantially parallel to the first axis 94 by virtue of a spline nut member 116 of the ball-screw spline assembly 108 being concentrically mounted about the first axis 94 on the drive housing 100. The Scotch yoke assembly 106 also comprises a first cam follower 118*a* coupled to the driven output shaft 104 along a fourth axis 120 whose eccentricity is determined via selective positional adjustment of a shaft member 122 of a transverse slide assembly 156 mounted upon the driven output shaft 104. As further explained below, the fourth axis 120 is nominally parallel to the third axis 110 and eccentrically disposed therefrom by a distance equal to one half of a resulting stroke of the non-rotating shaft member 114 of the ball-screw spline assembly 108.

A rotary nut ball screw sub-assembly 124 of the ball-screw spline assembly 108 is used for converting the oscillating translational motion of the non-rotating shaft member 114 into an oscillating rotational motion of the primary hub 92. A ball bearing supported outer race 126 of the rotary nut ball screw sub-assembly 124 is fixedly mounted to the drive housing 100 with its rotational axis substantially coincident with the first axis 94. The primary hub 92 is mounted to a nut member 128 of the rotary nut ball screw sub-assembly 124 whereby the primary hub 92 and primary sheaves 46 are driven with the desired oscillating respective rotational motions.

In addition, similar but physically smaller first and second ball-screw spline assemblies 130*a* and 130*b* (also available from THK America, Inc.) are respectively utilized for similarly mounting and converting the eccentric motion of the shaft member 122, and second cam follower 118*b* mounted thereon, into the desired oscillating rotational motions of the secondary hubs 96*a* and 96*b*, and the secondary sheaves 48*a* and 48*b*. Cam blocks 132 mounted on the ends of non-rotating shaft members 134 of the ball-screw spline assemblies 130*a* and 130*b* facilitate this via bearing against the second cam follower 118*b* as a consequence of the reflected weight of the knees of the patient 12.

The ball-screw spline assemblies 130*a* and 130*b* are of course each positioned concentrically about the second axis 98, which second axis 98 is located at a selected phase leading angle of perhaps 60 degrees with respect to of the first axis 94. This results in the oscillating motions of the secondary hubs 96*a* and 96*b*, secondary sheaves 48*a* and 48*b*, and secondary portions 24*b* and 26*b* of the pulley-supported lines 24 and 26 leading the corresponding oscillating motions of the primary hub 92, primary sheaves 46, pulley supported lines 22*a* and 22*b*, and 28*a* and 28*b*, and primary portions 24*a* and 26*a* of the pulley-supported lines 24 and 26 by corresponding leading phase angles of 60 degrees.

Figure 5:
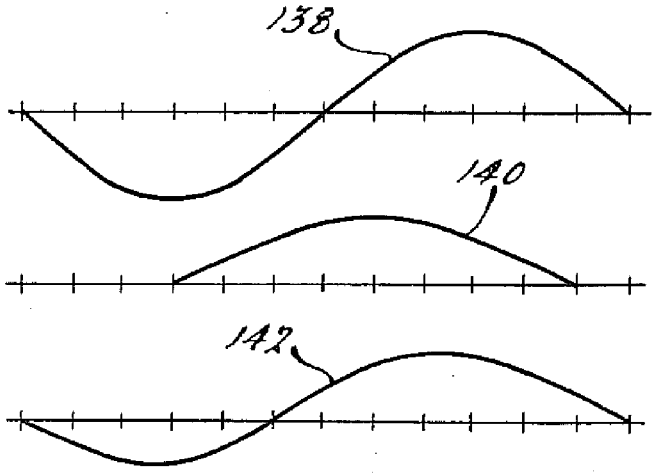
FIG. 5 is a graphical representation of knee displacement attained though a complete walking stride on the walking motion apparatus.

In addition, a stop block 136 is utilized to limit motions of the cam blocks 132 such that contact between the cam blocks 132 and the second cam follower 118*b* is limited to approximately 240 degrees of rotation of the driven output shaft 104. The resulting superposition of either of the primary and secondary portions 24*a* and 24*b* of the pulley supported line 24, or the primary and secondary portions 26*a* and 26*b* of the pulley supported line 26 is shown in FIG. 5 wherein the sinusoidal motion of either of the primary portions 24*a* or 26*a* is depicted by curve 138 and the discontinuous partially sinusoidal motion of either of the secondary portions 24*b* or 26*b* is depicted by curve 140. These oscillating motions are then summed and divided by a factor of two via the block and tackle function of the pulley blocks 42 as depicted by curve 142 thus yielding the desired flexure of the knees of the patient 12 during the walking motion.

In detail, the method of fixedly coupling a shaft to a machine element having a flat surface depicted in FIG. 6 includes forming a multitude of suitably contoured slots 144 transversely across an orthogonally cut face 146 of a shaft such as the shaft member 114 and a corresponding number of suitably contoured shallow depth holes 148 in a flat surface such as surface 150 of the yoke member 112. Then a corresponding number of balls 152 are inserted into the shallow depth holes 148 and the slots 144 of the shaft member 114 are forcibly drawn into contact with the balls 152 with a bolt 154. Utilizing the balls 152 in this manner is nominally equivalent to implementing a face gear coupling. Alternately of course, any other type of face gear coupling could be utilized. Two examples of suitable face gear couplings for this purpose are Curvic couplings manufactured on machinery available from Gleason Corp. (The Gleason Works) of Rochester, N.Y. and Endicon couplings available from ITW Spiroid of Glenview, Ill.

Figure 7:
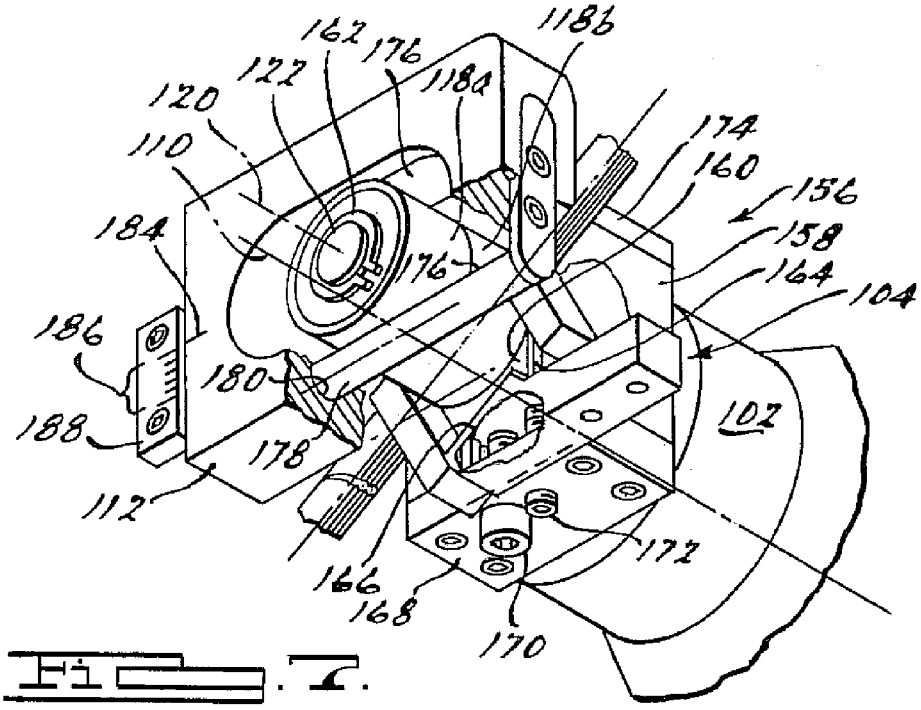
FIG. 7 is a partially cut-away isometric view of a subassembly of the rhythmic limb elevation drive unit depicted in FIG. 4.

As particularly depicted in FIG. 7, the eccentricity of the fourth axis 120 is adjustable via use of a transverse slide assembly 156. Unfortunately, industrial components such as boring bar holders or tooling slides are perhaps twice as large (e.g., in all directions) as is practical for use in the transverse slide assembly 156. The problem is resolved herein by a unique design wherein a fixed member 158 is fixedly mounted upon the driven output shaft 104 of the gearmotor 102 and utilized for slidingly mounting an adjustable sliding element 160 of the transverse slide assembly 156. The adjustable sliding element 160 comprises the shaft member 122 for mounting the first and second cam followers 118*a* and 118*b* as retained thereon by a retaining ring 162. Engagement of external serrations 164 formed on the adjustable sliding element 160 with internal serrations 166 formed within the fixed member 158 form a high load bearing interface between the adjustable sliding element 160 and the fixed member 158. The adjustable sliding element 160 is adjusted and then fixedly positioned with reference to a front end plate 168 via differential adjustment of a bolt 170 and set screw 172. In fact, the bolt 170 and set screw 172 provide a force couple to the adjustable sliding element 160 that serves to take up clearances between the external and internal serrations 164 and 166. A rear end plate 174 is also provided for limiting travel of the adjustable sliding element 160.

Drive forces are transmitted from the first cam follower 118*a* to the yoke member 112 via either of hardened flat surfaces 176 of half-round bearing members 178 and mating female seats 180 formed in the yoke member 112. Utilization of the half-round bearing members 178 for this purpose is desirable because it allows the hardened flat surfaces 176 to position themselves in a juxtaposed manner with the outer surface of the first cam follower 118*a* irregardless of component mounting surface tolerances and/or load sourced deflections.

Preferably whenever a patient 12 intends to pre-select a new stroke length, the gearmotor 102 is first stopped at a position whereat the fourth axis 120 is nominally positioned along the first axis 94 at a location nearest the primary hub 92 in the manner depicted in FIG. 7. (This is done via first opening a cover 182 to expose the internal components of the rhythmic limb elevation drive unit 36 and then defeating a safety interlock (not shown) in order to drive and then verify that the gearmotor 102 is stopped in the correct position, and of course, to provide access to the bolt 170 and set screw 172.) This not only gives the patient 12 the most convenient access to the bolt 170 and set screw 172, but it juxtapositions a stroke reference mark 184 located on the yoke member 112 opposite an instantly appropriate one of multiple stroke length marks 186 on a stroke length scale 188 located on the drive housing 100 (again, not shown in either of FIG. 4 or 7 for clarity). Thus, the patient 12 has a reasonably accurate reference by which he or she can set predetermined stroke lengths for the powered RLE apparatus. In the depiction shown in FIG. 7 for instance, the transverse slide assembly 156 is set for a maximum stroke value of perhaps 36 inches for the left and right articulated slide assemblies 30*a* and 30*b*.

Figure 8A:
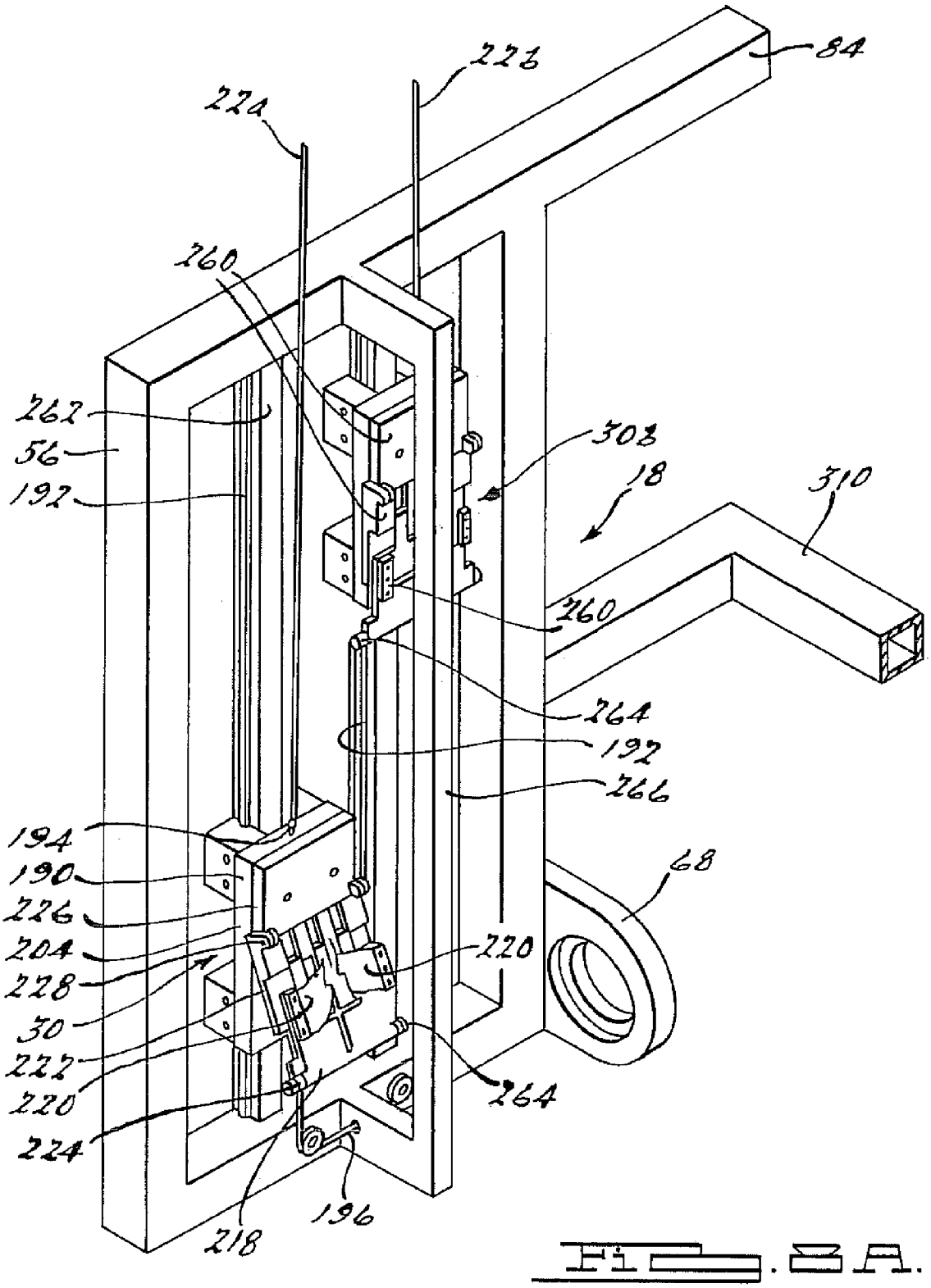
FIGS. 8A, 8B and 8C are isometric and sectional views depicting a walking motion apparatus foot guiding mechanism.
Figure 8B:
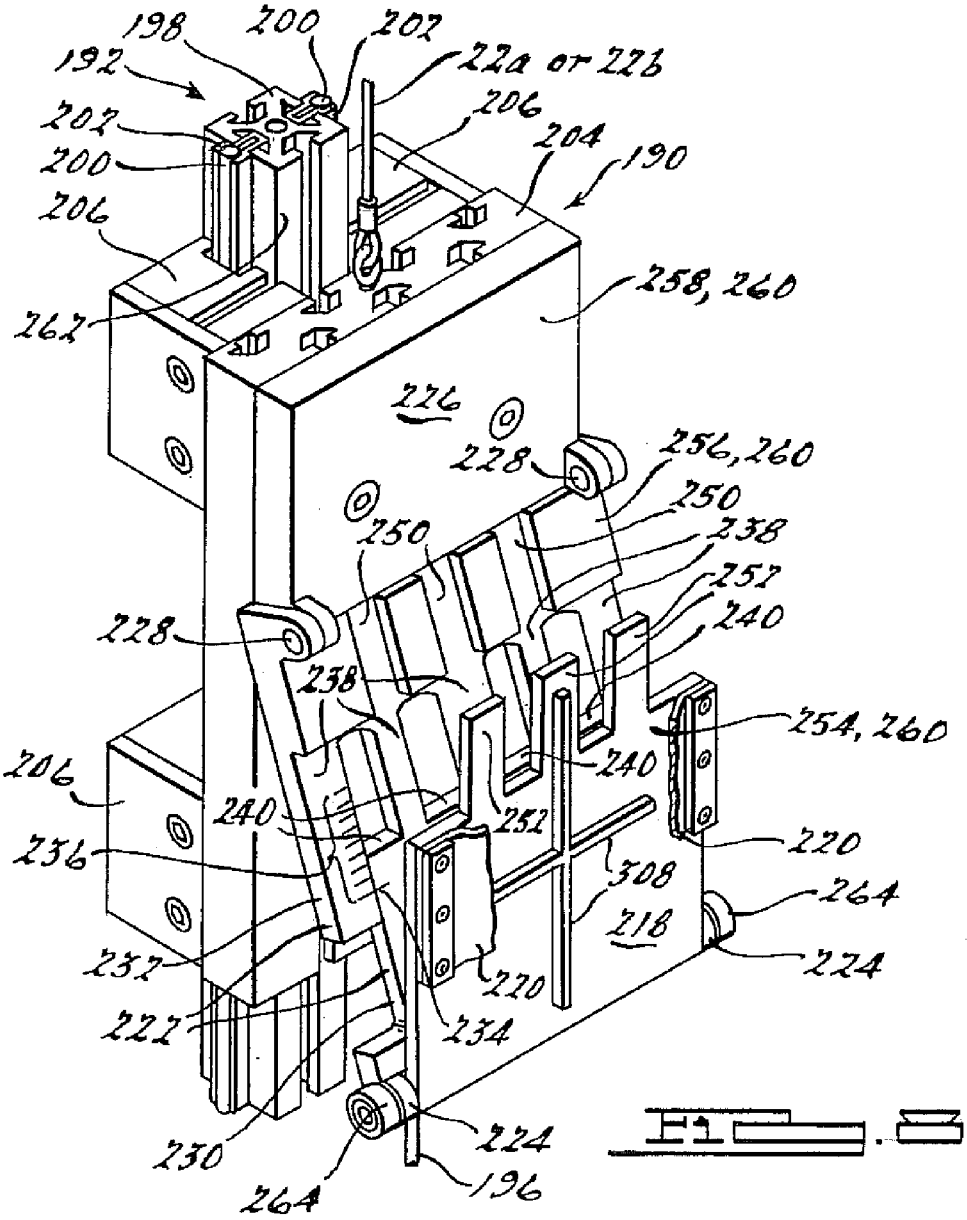
Figure 8C:
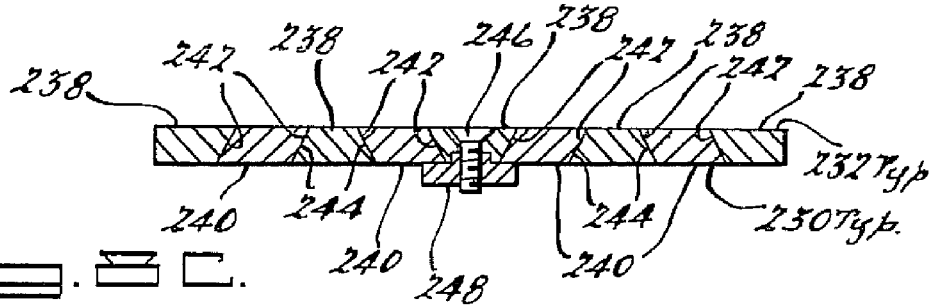

With reference now to FIGS. 8A, 8B and 8C, there shown in accordance with a third alternate preferred embodiment of the present invention are views depicting the foot guiding mechanism 18. The foot guiding mechanism 18 includes the left and right articulated slide assemblies 30*a* and 30*b* each comprising a slide member 190 positioned for movement along left or right longitudinally oriented rails 192. The first and second pulley-supported lines 22*a* and 22*b* are attached to the upper ends of the slide members 190 via anchors 194. In addition, a single pulley-supported line 196 is similarly attached to the lower ends thereof in order to ensure continuous downward motion of the left or right articulated slide assembly 30*a* or 30*b* not instantly being pulled upwards by its respective first or second pulley-supported line 22*a* or 22*b* in the unlikely event of an upward force being exerted thereon by a patient 12, and that any such upward force is properly applied to the rhythmic limb elevation drive unit 36 via the other articulated slide assembly 30*b* or 30*a* and respective pulley-supported line 22*b* or 22*a*.

The slide members 190 and longitudinally oriented rails 192 can of course be formed in a variety of known ways. As particularly depicted in FIG. 8B however, the slide members 190 and longitudinally oriented rails 192 are constructed from components of a "Roller System 10" available from the Industrial Profile Systems Business Unit of Parker Hannifin Corporation of Houston, Tex. in accordance with a parts list and instructions presented in a section entitled "Linear Applications" of their Catalog 1816/USA. The longitudinally oriented rails 192 each comprise a first extrusion "profile" 198 and a pair of hardened shaft members 200 retained by shaft clamps 202 while the slide members 190 each comprise a second extrusion "profile" 204 and four bearing units 206.

Figure 9A:
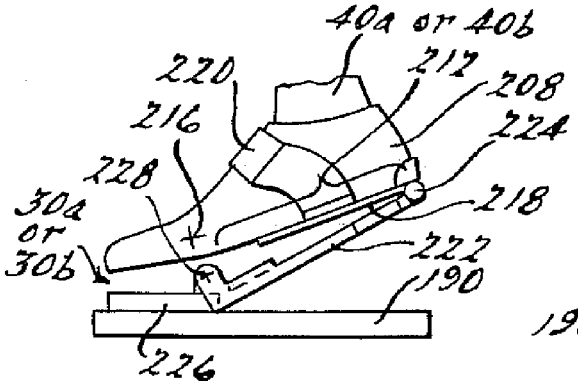
Figure 9B:
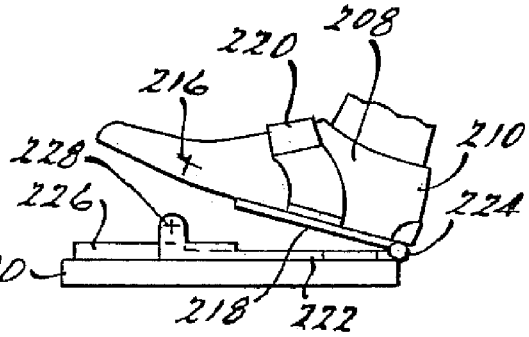
Figure 9C:
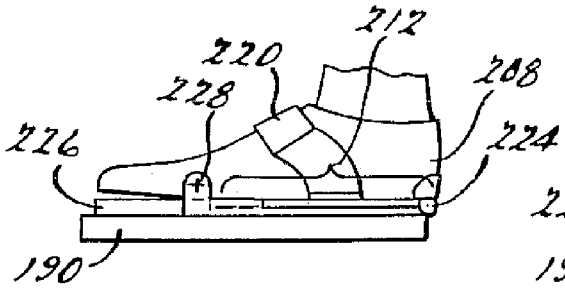
Figure 9D:
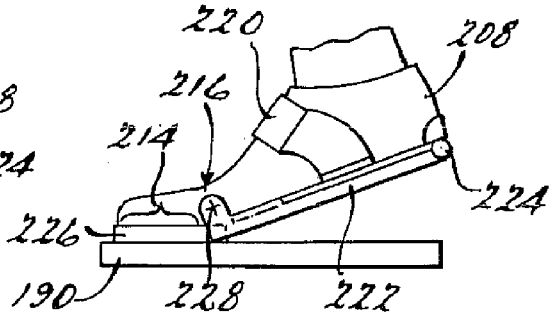

As depicted in FIGS. 9A, 9B, 9C and 9D, there are four basic patient foot positions during a single desired natural walking stride. As shown in FIG. 9A, the stride begins with the patient's leg and foot 40*a* or 40*b* swinging forward in an involuntary manner with his or her shoe 208 being somewhat elevated. Then as shown in FIG. 9B, the weight supporting portion of the stride begins with the heel 210 of the shoe 208 landing first. Next as shown in FIG. 9C, the whole posterior portion 212 of the shoe 208 is weight bearing and is supported by component members of the left or right articulated slide assembly 30*a* or 30*b*. And finally as shown in FIG. 9D, only the forefoot portion 214 of the shoe 208 is weight bearing as a ball-of-the-foot flexure point 216 of the shoe 208 flexes in a manner appropriate for toe-off toward beginning a new stride.

It is of course necessary to provide for proper patient foot and lower leg location with respect to either of the left and right articulated slide assemblies 30*a* and 30*b* during all phases of the desired walking motion. As shown somewhat in FIGS. 9A, 9B, 9C and 9D, and in greater detail in FIG. 8B, this can be accomplished by coupling the patient's shoes 208 to the slide members 190 via appropriate linkage members and articulation points. Posterior portions 212 of the patient's shoes 208 are fixedly held upon posterior foot supporting plates 218 by hook and loop (i.e., "Velcro") straps 220. The posterior foot supporting plates 218 are coupled to adjustable trailing link members 222 via under heel articulation points 224. The adjustable trailing link members 222 are in turn coupled to forefoot supporting members 226 via ball-of-the-foot articulation points 228.

The adjustable trailing link members 222 are formed in the bifurcated manner described in detail below so that their lengths can be adjusted such that ball-of-the-foot flexure points 216 of each of the patient's shoes 208 fall directly between the ball-of-the-foot articulation points 228 prior to use of the walking motion apparatus 10. This is most effectively done by moving rear elements 230 of the adjustable trailing link members 222 with respect to front elements 232 thereof such that alignment marks 234 are aligned with appropriate ones of shoe size depicting marks 236 before clamping the front elements 232 to the rear elements 230.

The front and rear elements 232 and 230 are formed with respective interleaving dovetail shaped and angled fingers 238 and 240 such that the rear elements 230 can slide longitudinally with respect to the front elements 232 but not separate from them. As shown particularly in FIG. 8C, the dovetail shaped and angled fingers 238 and 240 can most conveniently be formed by making oppositely angled grooves 242 having parallel sides in the front elements 232, and dovetail shaped grooves 244 from opposite sides in the rear elements 230.

After they are properly positioned, the front elements 232 are clamped to the rear elements 230 via flat head bolts 246 and clamping nuts 248 pulling juxtaposed ones of the angled fingers 240 against the center dovetail shaped fingers 238. Cavities (not shown) are formed in the tops of the second extrusion profiles 204 in order to provide clearance for the clamping nuts 248 whenever the adjustable trailing link members 222 are collapsed downward against the second extrusion profiles 204.

Forward portions of the front elements 232 are formed in a generally thickened manner with longitudinally oriented slots 250 suitable for accepting fingers 252 formed on the posterior foot supporting plates 218. Then whenever the posterior foot supporting plates 218 and adjustable trailing link members 222 are collapsed downward against one another and against the second extrusion profiles 204, their top surfaces 254 and 256, along with top surfaces 258 of the forefoot supporting members 226, combine to form shoe supporting surfaces 260 equidistant from and parallel to the top surfaces 262 of the left and right longitudinally oriented rails 192. And finally, it is preferred to limit upward motions of the under heel articulation points 224 during each stride via either of cam followers 264 making contact with a travel limiting bar 266 (i.e., shown in FIGS. 1B and 8A) should the patient 12 attempt to excessively lift his or her feet during the walking motion.

Figure 10:
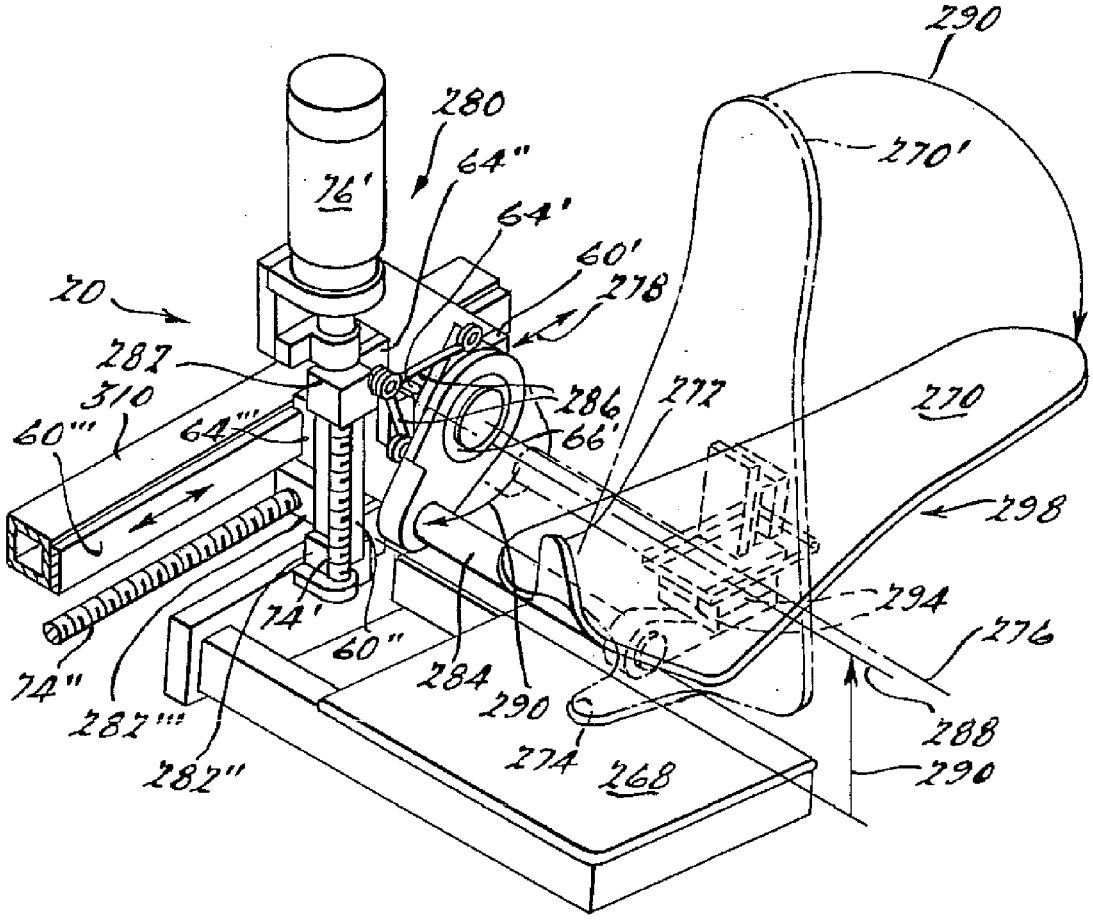
FIG. 10 is an isometric view of a walking motion apparatus patient handling mechanism.

With reference now to FIG. 10, there shown in accordance with a fourth alternate preferred embodiment of the present invention is the patient handling mechanism 20. The patient handling mechanism 20 comprises a seating platform 268 and a pivoting seat back 270 located with respect to one another such that a horn portion 272 of the pivoting seat back 270 nestles within a pocket 274 formed in the seating platform 268 when the pivoting seat back 270 is disposed in an upright seating position 270'. The pivoting seat back 270 is constrained for pivotal rotation about a transverse pivot axis 276 by another cross-roller bearing 66'. The cross-roller bearing 66' is in turn constrained for controlled motion along a non-powered slide axis 278 via longitudinal motion of another guide block 64' along another rail 60'. The non-powered slide axis 278 is located in a relatively elevated manner such that adequate clearance is provided for ensuing leg motion during the walking exercise after seat back 270 is rotated into a horizontal position.

Elevation toward the horizontal position is accomplished via a motion of a powered vertical slide assembly 280 comprising yet another guide block 64" moving along another rail 60" and powered by another Cyclo type drive gearmotor 76' and lead screw 74' moving a nut member 282' vertically from its initial position 282". This applies driving torque to an arm assembly 284 via tie rods 286 whereby the arm assembly 284 rotates about the transverse pivot axis 276. This causes various motions including constrained vertical motion of a transverse hip axis 288 and rotational motions of the arm assembly 284 and seat back 270 as indicated by the various arrows 290 plus minor translational motion of the transverse pivot axis 276 as required to accommodate the span between the transverse pivot and transverse hip axes 276 and 288. This ensures that the distance between the patient's hips 292 (shown in FIGS. 1A and 1B) and the foot guiding mechanism 18 remains nominally constant as the seat back 270 is elevated.

The seat back 270 itself is mounted upon a longitudinally oriented short stroke slide 294. The short stroke slide 294 is provided for accommodating normal up-and-down motions that the patient 12 will experience during the walking exercise. Finally, all of the above described components of the patient handling mechanism 20 are adjustably coupled to the angularly elevating frame 56 via a slide assembly 296 implemented by a side-by-side pair of guide blocks 64''' moving along a rail 60''' affixed to a longitudinally extending arm 310 and powered by still another Cyclo type drive gearmotor 76" (shown in FIG. 1B), lead screw 74" and nut member 282'''. Thus, the patient handling mechanism 20 is constrained for longitudinally oriented motion in order to provide for the above-mentioned overall positioning of the patient 12 with respect to the foot guiding mechanism 18.

In addition, interchangeable seat backs 270 are accommodated via a seat back interchanging mechanism 298 located above the short stroke slide 294. This is deemed necessary herein because patients 12 come in all torso lengths and girths. Furthermore, different seat back designs are required for patients having varying degrees of torso control. For instance, the particular seat back 270 depicted in FIG. 10 is intended for use by a patient 12 having good torso control. On the other hand, a quadriplegic or brain injured patient 12 may need torso and even head constraints while a patient nearly ready to walk on his or her own would desire a compliant seat back 270, or perhaps even an articulated seat back 270.

In actually utilizing the walking motion apparatus 10, a wheelchair bound patient 12 uses a controller 300 (shown in FIGS. 1A and 1B) to position the elevation drive mechanism 14 to an intermediate position whereat he or she can conveniently open the rhythmic limb elevation drive unit 36 and set leg stroke length. Then he or she resets the elevation drive and patient handling mechanisms 14 and 20 to base positions whereat the horn portion 272 of the pivoting seat back 270 nestles within the pocket 274 formed in the seating platform 268 such that the pivoting seat back 270 and seating platform 268 together form the upright seating position 270' at normal chair height. Next, the he or she moves to a position laterally proximate to the seating platform 268. Then using his or her hands 34*a* and 34*b* on the wheelchair, a buddy board (if desired) and the seating platform 268, the patient 12 moves onto the seating platform 268 in a centered position whereat he or she is positioned astride the horn portion 272 of the of the pivoting seat back 270. Again using the controller 300, the patient 12 repositions the patient handling mechanism 20 forward and perhaps partially elevates the seat back 270 to a point and attitude whereat he or she can conveniently position his or her shoes 208 upon the posterior foot supporting plates 218 of the articulated slide assemblies 30*a* and 30*b*, and affix them thereat with the hook and loop straps 220. Then again using the controller 300, the patient 12 moves the patient handling mechanism 20 to a fail-safe travel limited location sufficiently removed from the foot guiding mechanism 18 for optimizing the intended walking motion. Next, the patient 12 rotates the pivoting seat back 270 and him- or herself into a supine position with his or her thighs straddling the horn portion 272 of the pivoting seat back 270, and thus centered during the walking exercises to follow. At any time, the patient 12 presets a selected walking frequency into the controller 300. Finally, he or she grabs the arm elevating pulley-supported lines 28*a* and 28*b*, and activates the rhythmic limb elevation drive unit 36 via lateral arm motion against a latching on/off switch 302 (shown in FIGS. 1A and 1B) to implement the intended walking exercise. Whenever the scheduled walking exercise program is completed, the patient 12 stops the rhythmic limb elevation drive unit 36 by again activating the latching on/off switch 302 and then extricates him- or herself from the walking motion apparatus 10 by reversing the above described procedure.

Depicted in FIGS. 11A and 11B are apparatus for positioning a patient's shoe 208 on a posterior foot supporting plate 218. As depicted in FIG. 11A, shoe orienting grooves 304 are formed in the shoe 208 with intersection point 306 located at a selected distance ahead of the shoe's heel 210. Meanwhile as depicted in FIG. 11B, matching protrusions 308 are formed in the posterior foot supporting plate 218 at a corresponding distance ahead of the under heel articulation point 224. Such shoe orienting grooves 304 can easily be formed in relatively thick shoe soles such as those found on the running shoes usually favored by paraplegic patients 12 via a sawing or milling operation (not otherwise depicted herein). In any case, it is desirable for the shoe orienting grooves 304 to be cut on an individualized basis for each patient 12 because they can then be customized in accordance with each patient's preferred foot plant orientation.

Figure 14:
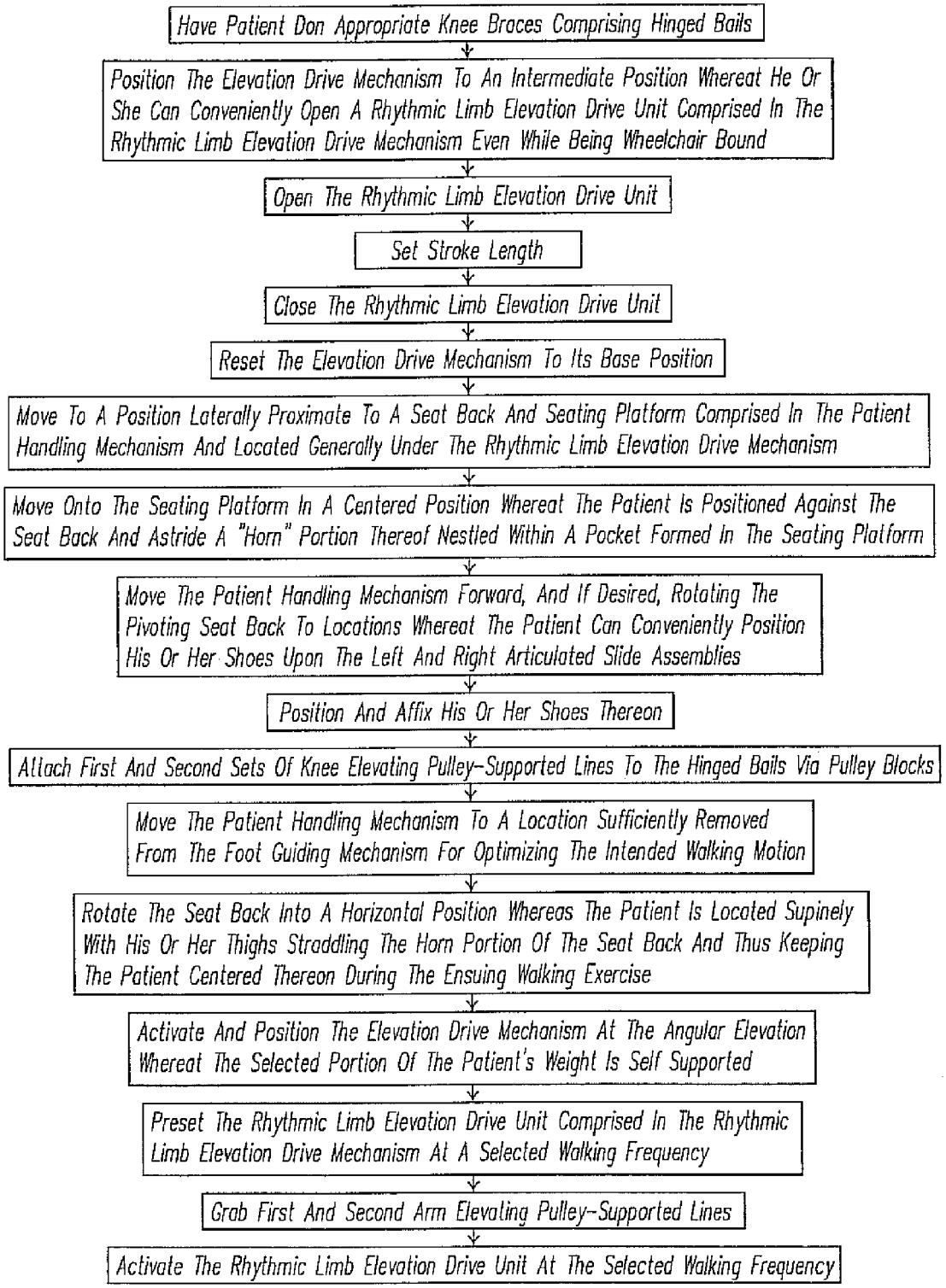
FIG. 14 is yet another flow chart depicting a method for enabling the patient to set up and get into the walking motion apparatus, to properly attach him- or herself to a rhythmic limb elevation drive mechanism thereof, and then to operate the walking motion apparatus—all without assistance.

Finally, presented in a fifth alternate preferred embodiment of the present invention are methods for improving a patient's cardiovascular circulation, growing high quality muscle mass, and even of firing muscle groups normally utilized in walking as depicted in FIGS. 12, 13 and 14. The most general method is depicted in FIG. 12 and is implemented in conjunction with utilization of a walking motion apparatus comprising at least the rhythmic limb elevation drive mechanism 16 and the foot guiding mechanism 18 wherein a supinely disposed paraplegic or quadriplegic patient 12 can affect a substantially normal walking motion, and wherein the method comprises the steps of: the patient donning appropriate knee braces 32*a* and 32*b* comprising hinged bails 44; positioning the patient 12 in the supine position under the rhythmic limb elevation drive mechanism 16; positioning and affixing the patient's shoes 208 upon left and right articulated slide assemblies 30*a* and 30*b* comprised in the foot guiding mechanism 18; attaching first and second limb groups each including one of the hinged bails 44, and an opposing hand 34*b* or 34*a* to first and second sets of pulley-supported lines 24 (i.e., via a coupled pulley block 42), 26 (i.e., via another similarly incorporated pulley block 42), and 28*a* and 28*b* comprised in the rhythmic limb elevation drive mechanism 16; and activating a rhythmic limb elevation drive unit 36 comprised in the rhythmic limb elevation drive mechanism 16 at a selected walking frequency.

Depicted in FIG. 13 is an enhanced version of the most general method wherein the walking motion apparatus additionally comprises the elevation drive mechanism 14 whereby the supinely disposed patient 12 can affect the substantially normal walking motion while supporting a selected portion of his or her weight, and wherein the method comprises the additional step of: activating the elevation drive mechanism 14 to an angular elevation whereat the patient is supporting a selected portion of his or her weight prior to activating the rhythmic limb elevation drive unit 36 at the selected walking frequency.

Finally, depicted in FIG. 14 is a still further enhanced method wherein a walking motion apparatus 10 additionally comprises the patient handling mechanism 20 whereby the patient 12 (e.g., in this case specifically meaning a patient 12 having functional use of his or her hands) can, without assistance, set up and get into the walking motion apparatus 10, properly attach him- or herself to the rhythmic limb elevation drive mechanism 16, and operate the walking motion apparatus 10, wherein the method comprises the patient 12 performing the steps of: the patient donning appropriate knee braces 32*a* and 32*b* comprising hinged bails 44; positioning the elevation drive mechanism 14 to an intermediate position whereat he or she can conveniently open the rhythmic limb elevation drive unit 36 comprised in the rhythmic limb elevation drive mechanism 16 even while being wheelchair bound; opening the rhythmic limb elevation drive unit 36; setting stroke length; closing the rhythmic limb elevation drive unit 36; resetting the elevation drive mechanism 14 to its base position; moving to a position laterally proximate to a pivoting seat back 270 and seating platform 268 comprised in the patient handling mechanism 20 and located generally under the rhythmic limb elevation drive mechanism 16; moving onto the seating platform 268 in a centered position whereat the patient is positioned against the seat back 270 and astride a "horn" portion 272 thereof nestled within a pocket 274 formed in the seating platform 268; moving the patient handling mechanism 20 forward, and if desired, rotating the pivoting seat back 270 to locations whereat the patient can conveniently position his or her shoes 208 upon the left and right articulated slide assemblies 30*a* and 30*b*; positioning and affixing his or her shoes 208 thereon; attaching first and second knee elevating pulley-supported lines 24 and 26 to the hinged bails 44 via pulley blocks 42; moving the patient handling mechanism 20 to a location sufficiently removed from the foot guiding mechanism 18 for optimizing the intended walking motion; rotating the seat back 270 into a horizontal position whereat the patient 12 is located supinely with his or her thighs straddling the horn portion 272 of the seat back 270 and thus keeping him or her centered thereon during the ensuing walking exercise; activating and positioning the elevation drive mechanism 14 at the angular elevation whereat the selected portion of the patient's weight is self supported; presetting the rhythmic limb elevation drive unit 36 comprised in the rhythmic limb elevation drive mechanism 16 at the selected walking frequency; grabbing first and second arm elevating pulley-supported lines 28*a* and 28*b*; and activating the rhythmic limb elevation drive unit 36 at the selected walking frequency.

Having described the invention, however, many modifications thereto will become immediately apparent to those skilled in the art to which it pertains, without deviation from the spirit of the invention. For instance, alternate elevation drive mechanisms and/or patient handling mechanisms could be utilized without deviation from the spirit of the invention. In any case, such modifications clearly fall within the scope of the invention.

COMMERCIAL APPLICABILITY

It is believed herein that utilization of the walking motion apparatus 10 of the present invention by paraplegic, quadriplegic, brain injured and various other handicapped patients in implementing the above described walking exercise would be of significant value to them, and therefore, that the walking motion apparatus 10 will find broad acceptance both here in America and abroad.

The invention claimed is:

1. A walking motion apparatus for drivingly implementing true walking exercise by an incapacitated patient comprising:

a foot guiding mechanism having left and right supporting rails, and left and right articulated slide assemblies adapted for having the patient's left and right feet respectively coupled thereto in a supportive manner and positioned for movement along the left and right supporting rails;

first and second hinged bails for supporting the patient's left and right knees;

a first set of pulley-supported lines for supporting and driving a first limb group of the patient including his or her left foot via the left articulated slide assembly, his or her left knee via the first hinged bail, and his or her right hand;

a second set of pulley-supported lines for supporting and driving a second limb group of the patient including his or her right foot via the right articulated slide assembly, his or her right knee via the second hinged bail, and his or her left hand;

a rhythmic limb elevation drive unit for driving the first and second sets of pulley-supported lines in an oscillating translational manner and thus drivingly implementing the desired walking motions of the patient's first and second limb groups; and a frame structure for mounting the foot guiding mechanism, rhythmic limb elevation drive unit and supporting the patient.

2. The walking motion apparatus of claim 1 wherein the rhythmic limb elevation drive unit comprises:

knee supporting pulley blocks coupled to the hinged bails;

primary, and first and second secondary hubs constrained for oscillating rotational motion;

a primary sheave assembly mounted upon and drivingly coupled to the primary hub, and first and second secondary sheaves mounted upon and drivingly coupled to the first and second secondary hubs, where the first and second sets of pulley-supported lines are selectively attached to the various sheaves with first and second double ended ones thereof being attached to and coupling selected sheaves of the primary sheave assembly and the first and second secondary sheaves via the knee supporting pulley blocks;

a gearmotor having a driven output shaft that rotates continuously at a selected rotational speed during operation of the rhythmic limb elevation drive unit; and continuous rotation to oscillating rotational motion conversion apparatus for drivingly coupling the output shaft of the gearmotor to the primary and secondary hubs for driving the primary and secondary hubs and sheaves in an oscillating rotational manner at a frequency equal in value to the rotational speed of the output shaft, and thereby driving the first and second sets of pulley-supported lines in an oscillating translational manner and thus drivingly implementing a desired motion of the patient's first and second limb groups at that frequency in a natural walking motion including appropriate flexing of the knees.

3. The walking motion apparatus of claim 2 wherein the continuous rotation to oscillating rotational motion conversion apparatus comprises:

a primary ball-screw spline assembly comprising a first shaft member having ball screw raceways and ball spline grooves crossing one another, a ball spline nut, a ball screw nut and a ball bearing supported outer race surrounding the ball screw nut;

a Scotch yoke assembly fixedly coupled to the first shaft member;

a first cam follower adapted for continuously driving the Scotch yoke assembly;

secondary ball-screw spline assemblies each comprising second shaft members having ball screw raceways and ball spline grooves crossing one another, ball spline nuts, ball screw nuts and ball bearing supported outer races surrounding the ball screw nuts;

cam blocks fixedly coupled to the second shaft members;

a stop block for limiting inward travel of the cam blocks;

a second cam follower for intermittently driving the cam blocks beyond their stop block limited positions;

an eccentric shaft member for concomitantly driving the first and second cam followers; and a transverse slide assembly comprising a fixed member fixedly mounted upon the output shaft of the gearmotor, an adjustable sliding element comprising the eccentric shaft member, and an adjustment assembly for positioning the adjustable sliding element at a preselected eccentricity with respect to the output shaft of the gearmotor.

4. The walking motion apparatus of claim 1 wherein the foot guiding mechanism having left and right supporting rails, and left and right articulated slide assemblies further comprises:

first and second pulley-supported lines of the first and second sets of pulley-supported lines being respectively attached to upper ends of the left and right articulated slide assemblies;

a single pulley-supported line for coupling lower ends of the left and right articulated slide assemblies in order to ensure continuous downward motion of the left or right articulated slide assembly not instantly being urged upwards by its respective first or second pulley-supported line in the event of an upward force being exerted thereon by a patient, and that any such upward force is properly applied to the rhythmic limb elevation drive unit via the other articulated slide assembly and respective pulley-supported line; and articulative foot supporting assemblies for articulatively coupling the patient's feet to the articulated slide assemblies in order to allow for proper foot and leg articulation during a walking exercise.

5. The walking motion apparatus of claim 4 wherein the articulative foot supporting assemblies comprise:

posterior foot supporting plates having shoe orienting protrusions for orienting and supporting a patient's shoes formed with corresponding grooves;

straps for holding the patient's shoes in place on the posterior foot supporting plates as located by the foot orienting protrusions;

adjustable trailing link members coupled to the posterior foot supporting plates by under heel articulation points, the adjustable trailing links being adjustable in order to properly accommodate various patient foot sizes;

slide members slidingly coupled to the rails; and ball-of-the-foot articulation points for coupling the adjustable trailing link members to the slide members.

6. The walking motion apparatus of claim 1 wherein the frame structure includes an elevation drive mechanism comprising:

a stationary floor mounted frame;

an angularly elevating frame rotationally coupled to the stationary floor mounted frame whereupon the foot guiding mechanism and rhythmic limb elevation drive unit are mounted, and the patient is supportively located with respect to either;

a controller; and angular elevation drive apparatus operatively adapted for selective rotational positioning of the angularly elevating frame with respect to the stationary floor mounted frame in response to operation of the controller.

7. The walking motion apparatus of claim 6 wherein the angular elevation drive apparatus comprises:

a rail fixedly mounted on a nominally horizontal member of the stationary floor mounted frame;

a guide block slidingly coupled to the rail; a nut affixed to the guide block;

a drive gearmotor;

a lead screw drivingly coupled to the drive gearmotor and engaging the nut;

a roll and yaw-axes constraining bearing mounted upon the guide block;

off-axis vertical and arm members respectively included as portions of the stationary floor mounted and angularly elevating frames; and a pitch axis constraining tie-rod for coupling tie-rod anchor points of the off-axis vertical and arm members one to another with a predetermined span length therebetween, whereby the angularly elevating frame can be angularly elevated in dependence upon instant locations of the guide block along the rail as implemented by controlled operation of the drive gearmotor via the controller.

8. The walking motion apparatus of claim 1 wherein the walking motion apparatus additionally includes a patient handling mechanism comprising;

a seating platform;

a pivoting seat back having a nominally orthogonal horn portion wherein the pivoting seat back is located with respect to the seating platform such that the horn portion nestles within a pocket formed in the seating platform when the pivoting seat back is disposed in an upright seating position;

a pivoting mechanism adapted for rotationally elevating the pivoting seat back into a nominally supine position; and a drive mechanism for drivingly elevating and pivoting the seat back in accordance with the positional constraints imposed by the pivoting mechanism.

9. The walking motion apparatus of claim 8 wherein the pivoting seat back and pivoting mechanism comprise:

a transverse pivot axis about which the seat back pivots that is located in a relatively elevated manner such that adequate clearance is provided for ensuing leg motion during the walking exercise after seat back is rotated into a horizontal position;

a transverse hip axis constrained for powered motion along a nominally vertical axis such that the distance between a patient's hips and a foot guiding mechanism remains nominally constant as the seat back is elevated;

a longitudinally oriented short stroke slide component for slidingly mounting the seat back along a longitudinal axis in order to accommodate normal up-and-down motions that a patient experiences during a walking exercise; and a powered slide assembly for adjustably coupling the pivoting mechanism to the angularly elevating frame along the longitudinal axis for appropriately locating the patient's hips with respect to the foot guiding mechanism.

10. A walking motion apparatus for drivingly implementing true walking exercise by an incapacitated patient comprising:

a stationary floor mounted frame;

an angularly elevating frame rotationally coupled to the stationary floor mounted frame whereupon a foot guiding mechanism and rhythmic limb elevation drive unit are mounted and the patient is supportively located with respect to the angularly elevating frame or to the stationary floor mounted frame;

a rail fixedly mounted on a nominally horizontal member of the stationary floor mounted frame;

a guide block slidingly coupled to the rail;

a nut affixed to the guide block;

a drive gearmotor;

a lead screw drivingly coupled to the drive gearmotor and engaging the nut;

a controller;

a roll and yaw-axes constraining bearing mounted upon the guide block;

off-axis vertical and arm members respectively included as portions of the stationary floor mounted and angularly elevating frames; and a pitch axis constraining tie-rod for coupling tie-rod anchor points of the off-axis vertical and arm members one to another with a predetermined span length therebetween, whereby the angularly elevating frame can be angularly elevated in dependence upon instant locations of the guide block along the rail as implemented by controlled operation of the drive gearmotor via the controller;

left and right articulated slide assemblies included as portions of the foot guiding mechanism;

first and second hinged bails for supporting the patient's left and right knees;

a first set of pulley-supported lines for supporting and driving a first limb group of the patient including his or her left foot via the left articulated slide assembly, his or her left knee via the first hinged bail, and his or her right hand;

a second set of pulley-supported lines for supporting and driving a second limb group of the patient including his or her right foot via the right articulated foot slide assembly, his or her right knee via the second hinged bail, and his or her left hand;

knee supporting pulley blocks coupled to the hinged bails;

a gearmotor included as a portion of the rhythmic limb elevation drive unit, the gearmotor having a driven output shaft that rotates continuously at a selected rotational speed during operation of the rhythmic limb elevation drive unit;

a fixed member fixedly mounted upon the output shaft of the gearmotor;

an adjustable sliding element comprising an eccentric shaft member;

an adjustment assembly for positioning the adjustable sliding element at a preselected eccentricity with respect to the output shaft of the gearmotor;

a first cam follower mounted upon the eccentric shaft member;

a Scotch yoke assembly adapted for being driven by the first cam follower;

a primary ball-screw spline assembly comprising a first shaft member having ball screw raceways and ball spline grooves crossing one another, a ball spline nut, a first ball screw nut and a ball bearing supported outer race surrounding the first ball screw nut, the first shaft member of which being fixedly coupled to and driven by the Scotch yoke assembly;

a second cam follower also mounted upon the eccentric shaft member;

cam blocks also adapted for being driven by the first cam follower;

a stop block for limiting inward travel of the cam blocks;

secondary ball-screw spline assemblies each comprising second shaft members having ball screw raceways and ball spline grooves crossing one another, ball spline nuts, second ball screw nuts, and ball bearing supported outer races surrounding the second ball screw nuts, the second shaft members being fixedly coupled to and intermittently driven by the cam blocks beyond their stop block limited positions;

a primary hub mounted upon the first ball screw nut and thereby being constrained for oscillating rotational motion;

first and second secondary hubs mounted upon either of the second ball screw nuts and thereby being constrained for intermittent oscillating rotational motion;

a primary sheave assembly mounted upon and drivingly coupled to the primary hub, and first and second secondary sheaves mounted upon and drivingly coupled to the first and second secondary hubs, where the first and second sets of pulley-supported lines are selectively attached to the various sheaves with first and second double ended ones thereof being attached to and coupling selected sheaves of a primary sheave assembly and the first and second secondary sheaves via the knee supporting pulley blocks, wherein the primary and secondary hubs and sheaves are thus driven in an oscillating rotational manner at a frequency equal in value to the rotational speed of the output shaft, and thereby drive the first and second sets of pulley-supported lines in an oscillating translational manner and thus drivingly implement a desired motion of the patient's first and second limb groups at that frequency in a natural walking motion including appropriate flexing of the knees;

left and right supporting rail members included as portions of the foot guiding mechanism;

wherein left and right articulated slide assemblies are positioned for movement along the left and right rails;

first and second pulley-supported lines of the first and second sets of pulley-supported lines being respectively attached to upper ends of the left and right articulated slide assemblies;

a single pulley-supported line for coupling lower ends of the left and right articulated slide assemblies in order to ensure continuous downward motion of the left or right articulated slide assembly not instantly being urged upwards by its respective first or second pulley-supported line in the event of an upward force being exerted thereon by a patient, and that any such upward force is properly applied to the rhythmic limb elevation drive unit via the other articulated slide assembly and respective pulley-supported line;

articulative foot supporting assemblies having posterior foot supporting plates, hook and loop straps, adjustable trailing link members and ball-of-the-foot articulation points; wherein the posterior foot supporting plates having shoe orienting protrusions for orienting and supporting a patient's shoes formed with corresponding grooves;

wherein the hook and loopstraps for holding the patient's shoes in place on the posterior foot supporting plates as located by the foot orienting protrusions;

wherein the adjustable trailing link members are coupled to the posterior foot supporting plates by under heel articulation points;

wherein the ball-of-the-foot articulation points for coupling the adjustable trailing link members to the articulated slide assemblies' slide members, the adjustable trailing links being adjustable in order to properly accommodate various patient foot sizes, wherein the articulative foot supporting assemblies enable articulative coupling the patient's feet to the articulated slide assemblies in order to allow for proper foot and leg articulation during a walking exercise;

a seating platform included as a portion of a patient handling mechanism for the walking motion apparatus;

a pivoting seat back having a nominally orthogonal horn portion wherein the pivoting seat back is located with respect to the seating platform such that the horn portion nestles within a pocket formed in the seating platform when the pivoting seat back is disposed in an upright seating position;

a pivoting mechanism adapted for rotationally elevating the pivoting seat back into a nominally supine position;

a transverse pivot axis about which the seat back pivots that is located in a relatively elevated manner such that adequate clearance is provided for ensuing leg motion during the walking exercise after seat back is rotated into a horizontal position;

a transverse hip axis constrained for powered motion along a nominally vertical axis such that the distance between a patient's hips and a foot guiding mechanism remains nominally constant as the seat back is elevated;

a longitudinally oriented short stroke slide component for slidingly mounting the seat back along a longitudinal axis in order to accommodate normal up-and-down motions that patients experience during a walking exercise; and a powered slide assembly for adjustably coupling the pivoting mechanism to the angularly elevating frame along the longitudinal axis for appropriately locating the patient's hips with respect to the foot guiding mechanism.

11. A method for improving a paraplegic or quadriplegic patient's cardiovascular circulation, growing high quality muscle mass, and even of firing muscle groups normally utilized in walking, wherein the method is implemented in conjunction with utilization of a walking motion apparatus comprising at least rhythmic limb elevation drive and foot guiding mechanisms wherein a supinely disposed such patient can affect a substantially normal walking motion, and wherein the method comprises the steps of:

the patient donning appropriate knee braces comprising hinged bails;

positioning the patient in the supine position under the rhythmic limb elevation drive mechanism;

positioning and affixing the patient's shoes upon left and right articulated slide assemblies comprised in the foot guiding mechanism;

attaching first and second limb groups each including one of the hinged bails and an opposing hand to first and second sets of pulley-supported lines comprised in the rhythmic limb elevation drive mechanism; and activating a rhythmic limb elevation drive unit comprised in the rhythmic limb elevation drive mechanism at a selected walking frequency.

12. The method of claim 11 wherein the walking motion apparatus additionally comprises an elevation drive mechanism whereby the supinely disposed patient can affect the substantially normal walking motion while supporting a selected portion of his or her weight, and wherein the method comprises the additional step of:

activating the elevation drive mechanism to an angular elevation whereat the patient is supporting a selected portion of his or her weight prior to activating the rhythmic limb elevation drive unit at the selected walking frequency.

13. A method for improving a paraplegic or quadriplegic patient's cardiovascular circulation, growing high quality muscle mass, and even of firing muscle groups normally utilized in walking, wherein the method is implemented in conjunction with utilization of a walking motion apparatus comprising rhythmic limb elevation drive, foot guiding, elevation drive and patient handling mechanisms whereby the patient can, without assistance, set up and get into the walking motion apparatus, properly attach him- or herself to the rhythmic limb elevation drive mechanism and operate the walking motion apparatus in order to achieve a substantially normal walking motion while supported in a selectively elevated supinely disposed position, and wherein the method comprises the patient performing the steps of:

positioning the elevation drive mechanism to an intermediate position whereat he or she can conveniently open a rhythmic limb elevation drive unit comprised in the rhythmic limb elevation drive mechanism even while being wheelchair bound;

opening the rhythmic limb elevation drive unit;

setting stroke length;

closing the rhythmic limb elevation drive unit;

resetting the elevation drive mechanism to its base position;

moving to a position laterally proximate to a pivoting seat back and seating platform comprised in the patient handling mechanism and located generally under the rhythmic limb elevation drive mechanism;

moving onto the seating platform in a centered position whereat the patient is positioned against the seat back and astride a "horn" portion thereof nestled within a pocket formed in the seating platform;

moving the patient handling mechanism forward, and, rotating the pivoting seat back to locations whereat the patient can conveniently position his or her shoes upon left and right articulated slide assemblies;

positioning and affixing his or her shoes thereon;

attaching first and second sets of knee elevating pulley-supported lines to hinged bails;

moving the patient handling mechanism to a location sufficiently removed from the foot guiding mechanism for optimizing the intended walking motion;

rotating the seat back into a horizontal position whereat the patient is located supinely with his or her thighs straddling the horn portion of the seat back and thus keeping him or her centered thereon during the ensuing walking exercise;

activating and positioning the elevation drive mechanism to an angular elevation whereat a selected portion of the patient's weight is self supported;

presetting the rhythmic limb elevation drive unit comprised in the rhythmic limb elevation drive mechanism at a selected walking frequency;

grabbing first and second arm elevating pulley-supported lines; and activating the rhythmic limb elevation drive unit at the selected walking frequency.

* * * * *

UNITED STATES PATENT AND TRADEMARK OFFICE

CERTIFICATE OF CORRECTION

PATENT NO. : 7,137,959 B2
APPLICATION NO. : 11/069174
DATED : November 21, 2006
INVENTOR(S) : Edward H. Phillips It is certified that error appears in the above-identified patent and that said Letters Patent is hereby corrected as shown below:

Column 3, line 54, delete the second occurrence of "of the"

Column 6, line 45, delete the first occurrence of "to the"

Column 13, line 27, replace "font" with --foot--

Column 16, 48, delete the second occurrence of "of"

Column 21, line 4, delete the second occurrence of "the"

Column 26, line 67, delete second occurrence of "foot"

Signed and Sealed this

Third Day of April, 2007

JON W. DUDAS
*Director of the United States Patent and Trademark Office*